US007008914B2

(12) United States Patent
Smith et al.

(10) Patent No.: US 7,008,914 B2
(45) **Date of Patent: *Mar. 7, 2006**

(54) ALKYLBENZENE DETERGENTS WITH HIGH 2-ISOMER CONTENT

(75) Inventors: George A. Smith, Austin, TX (US); Prakasa R. Anantaneni, Austin, TX (US); Samir S. Ashrawi, Austin, TX (US); Raeda M. Smadi, Round Rock, TX (US); John F. Knifton, Houston, TX (US); Melvin Stockton, Georgetown, TX (US)

(73) Assignee: Huntsman Petrochemical Corporation, Austin, TX (US)

( * ) Notice: Subject to any disclaimer, the term of this patent is extended or adjusted under 35 U.S.C. 154(b) by 266 days.

This patent is subject to a terminal disclaimer.

(21) Appl. No.: 10/263,547

(22) Filed: Oct. 3, 2002

(65) Prior Publication Data

US 2003/0166481 A1 Sep. 4, 2003

Related U.S. Application Data

(63) Continuation-in-part of application No. 09/559,841, filed on Apr. 26, 2000, now Pat. No. 6,562,776, and a continuation-in-part of application No. 09/616,568, filed on Jul. 14, 2000, now Pat. No. 6,630,430, and a continuation-in-part of application No. 09/174,891, filed on Oct. 19, 1998, now Pat. No. 6,133,492, and a continuation-in-part of application No. 08/879,745, filed on Jun. 20, 1997, now Pat. No. 6,315,964, which is a division of application No. 08/598,695, filed on Feb. 8, 1996, now Pat. No. 5,770,782, and a continuation-in-part of application No. 08/598,692, filed on Feb. 8, 1996, now Pat. No. 5,847,254.

(60) Provisional application No. 60/227,795, filed on Aug. 25, 2000, and provisional application No. 60/178,823, filed on Jan. 28, 2000.

(51) Int. Cl.
*C11D 17/00* (2006.01)

(52) U.S. Cl. ..... 510/352; 510/357; 510/424; 510/426; 510/492; 585/456

(58) Field of Classification Search ..... 510/352, 510/357, 424, 426, 492; 585/456
See application file for complete search history.

(56) References Cited

PUBLICATIONS

Rubinfeld, Joseph, E.M. Emery, and D. Cross "Structure and Performance Property Relations of Straight–Chain Alkylbenzenes vol. 4, Mar. 1965".*

J.L. G. de Almeida, M. Dufaux, Y. Ben Taarit and C. Naccache "Linear Alkylbenzene" JAOCS, vol. 71, No. 7 Jul. 1994.*

* cited by examiner

*Primary Examiner*—Necholus Ogden
(74) *Attorney, Agent, or Firm*—Christopher J. Whewell

(57) ABSTRACT

This invention is directed to a fluorine-containing mordenite catalyst and use thereof in the manufacture of alkylbenzene (LAB) by alkylation of benzene with an olefin. The olefin may have from about 10 to 14 carbons. The fluorine-containing mordenite is prepared typically by treatment with an aqueous hydrogen fluoride solution. The benzene alkylation may be conducted using reactive distillation. This invention is also directed to a process for production of LAB having a high 2-phenyl isomer content by use of the fluorine-containing mordenite in conjunction with a conventional solid LAB alkylation catalyst. The two catalysts may be used in a mixed catalyst bed or may be packed in series, with the relative proportions being adjusted to provide a desired 2-phenyl isomer content of in the final product.

54 Claims, 4 Drawing Sheets

ALKYLBENZENE DETERGENTS WITH HIGH 2-ISOMER CONTENT

CROSS-REFERENCES TO RELATED APPLICATIONS

This application is a continuation-in-part of the following applications: U.S. patent application Ser. No. 08/598,692, filed Feb. 8, 1996, now U.S. Pat. No. 5,847,254; U.S. patent application Ser. No. 08/879,745, filed Jun. 20, 1997, now U.S. Pat. No. 6,315,964 (which is a divisional application of Ser. No. 08/598,695, filed Feb. 8, 1996, now U.S. Pat. No. 5,770,782; U.S. patent application Ser. No. 09/174,891 filed Oct. 19, 1998, now U.S. Pat. No. 6,133,492; U.S. Provisional application No. 60/178,823, filed Jan. 28, 2000; U.S. patent application Ser. No. 09/559,841 filed Apr. 26, 2000; now U.S. Pat. No. 6,562,776; U.S. patent application Ser. No. 09/616,568 filed Jul. 14, 2000, now U.S. Pat. No. 6,630,430; and U.S. provisional patent application 60/227,795 filed Aug. 25, 2000, the contents of all which are expressly incorporated herein by reference.

BACKGROUND OF THE INVENTION

This invention generally relates to the alkylation of benzene with olefins using mordenite catalysts.

Linear alkylbenzenes (LAB's) having long chains (typically 10–14 carbons) are commonly used, commercial products. LAB's are commonly sulfonated to thereby produce surfactants.

Typically, LAB's are manufactured commercially using classic Friedal-Crafts chemistry, employing catalysts such as aluminum chloride, or using strong acid catalysts such as hydrogen fluoride, for example, to alkylate benzene with olefins. While such methods produce high conversions, the selectivity to the 2-phenyl isomer is low, generally being about 30% or less. LAB's with a high percentage of the 2-phenyl isomer are highly desired because such compounds when sulfonated have long "tails" which provide enhanced solubility and detergent properties.

Reactive distillation methods for producing short chain alkylated aromatics are known. These methods are typically directed toward reacting gaseous phase short chain olefins, such as ethylene or propylene, with benzene.

SUMMARY OF THE INVENTION

It has now been recognized that a need exists for a method of LAB production having high substrate olefin conversion, high selectivity to 2-phenyl isomer LAB, and employing a catalyst having long lifetimes and easy handling. This invention provides a solution to one or more of the problems and disadvantages described above.

It has now also been recognized that alkylation reactions using long chain olefins present peculiar problems. With longer chain liquid olefin reactants, lower space velocities may be necessary due to the low mutual solubilities of the feed components. Due to lower reaction temperatures, alkylation reactions involving long chain olefins may be prone to the accumulation of water brought into the alkylation unit with the feeds or formed as a by-product in the catalyst bed, leading to deactivation of the catalyst. Furthermore, because liquid olefins mix much less readily with liquid aromatics than do gaseous olefins, different mixing procedures are necessary in order to achieve high yields of desired LAB's. In addition, the use of longer chain liquid olefin reactants may lead to a greater tendency for the formation of carbonaceous deposits and heavy organics on the catalyst bed. The formation of carbonaceous deposits and heavy organics on the catalyst bed. By-product formation may generally be more difficult to control with the higher molecular weight olefin co-reactants. Thus, a need exists for a method of alkylation of aromatics with long chain olefins that has high olefin conversion, high selectivity and having long catalyst lifetimes. In particular, a need exists for a method of producing alkylated aromatics from liquid industrial reactant feeds containing water that avoids water deactivation of the catalyst and which ensures adequate mixing of the liquid aromatic and olefin reactants. A need also exists for such a method having high substrate olefin conversion and long catalyst lifetimes. More particularly, a need exists for a method of LAB production having high substrate olefin conversion, high selectivity to 2-phenyl isomer LAB, and employing a catalyst having long lifetimes and easy handling. LAB is useful as starting material to produce sulfonated LAB, which itself is useful as a surfactant.

The mordenite catalyst of this invention may be mixed with a different catalyst that does not afford high 2-phenyl isomer LAB production. The amounts of each catalyst can thus be adjusted to provide the desired levels of 2-phenyl isomer LAB in the product stream. In this way, LAB may be produced having a higher 2-phenyl isomer content than would be produced using the non-mordenite catalyst of this invention.

In one broad respect, this invention is a process for the production of linear alkylbenzenes, comprising:

contacting benzene and an olefin having about 8 to about 30 carbons in the presence of a mixed catalyst bed to form linear alkylbenzenes, wherein the mixed catalyst bed comprises fluorine-containing mordenite and a second, solid linear alkylbenzene alkylation catalyst, wherein the second alkylation catalyst has a selectivity to the 2-phenyl isomer of the linear alkylbenzenes less than the selectivity of the fluorine-containing mordenite.

In another broad respect, this invention is a process for the production of linear alkylbenzenes, comprising:

dehydrogenating a paraffin to form an olefin;

sending a feed stream of benzene and the olefin through a conduit to a linear alkylbenzenes alkylation reactor containing a fluorine-containing mordenite and a second alkylation catalyst, wherein the second alkylation catalyst has a selectivity to the 2-phenyl isomer of the linear alkylbenzenes less than the selectivity of the fluorine-containing mordenite;

reacting the benzene and olefin in the reactor to form a crude linear alkylbenzenes stream;

distilling the crude linear alkylbenzenes stream in a first distillation column to separate benzene that did not react and to form a benzene-free linear alkylbenzenes stream;

distilling the benzene-free linear alkylbenzenes stream in a second distillation column to separate any paraffin present and to form a paraffin-free linear alkylbenzenes stream;

distilling the paraffin-free linear alkylbenzene stream in a third distillation column to provide an overhead of a purified linear alkylbenzene stream and removing a bottoms stream containing heavies.

This invention, in another broad respect, is a process useful for the production of monoalkylated benzene, comprising contacting benzene with an olefin containing from about 8 to about 30 carbons in the presence of fluorine-containing mordenite under conditions such that linear monoalkylated benzene is formed.

In another broad respect, this invention is a process useful for the production of monoalkylated benzene, comprising introducing a feed comprising olefin having about 8 to about 30 carbons and benzene into a fluorine-containing mordenite catalyst bed under conditions such that monoalkylated benzene is produced, allowing benzene, olefin, and monoalkylated benzene to descend (fall) into a reboiler from the catalyst bed, removing monoalkylated benzene from the reboiler, and heating the contents of the reboiler such that benzene refluxes to further contact the fluorine-containing mordenite.

In another broad aspect, this invention relates to mordenite useful for alkylating benzene with olefin having a silica to alumina molar ratio of about 10:1 to about 100:1; wherein the mordenite has been treated with an aqueous hydrogen fluoride solution such that the mordenite contains from about 0.1 to about 4 percent fluorine by weight.

In another broad respect, this invention is a method useful for the preparation of fluorine-containing mordenite, comprising contacting a mordenite having a silica to alumina molar ratio in a range from about 10:1 to about 100:1 with an aqueous hydrogen fluoride solution having a concentration of hydrogen fluoride in the range of from about 0.1 to about 10 percent by weight such that the mordenite containing fluorine is produced, collecting the fluorine-containing mordenite by filtration, and drying.

In another broad respect, the present invention provides a process useful for preparing alkylated aromatic compounds comprising introducing an aromatic compound having from about 6 to about 30 carbons and an olefin having from about 8 to about 30 carbons above a catalyst bed containing an alkylation catalyst under conditions such that the olefin and the aromatic compound react to form an alkylated aromatic compound; allowing the alkylated aromatic compound and unreacted aromatic compound to descend into a reboiler from the catalyst bed; withdrawing the alkylated aromatic compound from the reboiler; and heating contents of the reboiler such that the aromatic compound refluxes to contact the catalyst bed.

In another broad respect, this invention is a system for manufacturing alkylated aromatic compounds, comprising a reactor containing an alkylation catalyst bed; one or more injectors in the reactor for introducing aromatic compound, olefin or a mixture of aromatic compound and olefin above the catalyst bed; a reboiler for collecting, heating and refluxing unreacted aromatic compound descending from the reactor, the reboiler positioned below and in communication with the reactor, the reactor and reboiler being generally in vertical alignment; and a means for withdrawing alkylated aromatic compound from the reboiler.

It has also been found that the catalyst of this invention may be used in combination with an existing aluminum chloride or hydrogen fluoride alkylation facility to afford LAB having a higher 2-phenyl isomer content than would otherwise be available from such plant. Thus, an existing facility may be retrofitted to include one or more reactors containing the fluorine-containing mordenite of this invention. In this manner, a slip stream of reactants may be sent to the mordenite with effluent therefrom being introduced back into the conventional alkylation system. This embodiment has several advantages. For example, the cost of capital is minimized since conventional equipment will already be in place. Also, the retrofitted plant can produce higher 2-phenyl isomer LAB at the discretion of its operator, depending on need. That is, the plant need not produce strictly high 2-phenyl isomer LAB and can instead produce high 2-phenyl isomer at its discretion. In one embodiment, a slip stream of reactant is drawn and sent to one or more reactors containing fluorine-containing mordenite catalyst. The effluent from the fluorine-containing mordenite reactor may then be combined with effluent from the HF or aluminum chloride reactor to provide a product having a higher level of 2-phenyl isomer LAB than would otherwise be present in product from an HF or aluminum chloride reactor.

In another broad respect, this invention is a process for the production of linear alkylbenzene, comprising:

contacting benzene and an olefin having about 8 to about 30 carbons in the presence of a fluorine-containing mordenite to form a first linear alkylbenzene stream;

contacting benzene and an olefin having about 8 to about 30 carbons in the presence of a conventional linear alkylbenzene alkylation catalyst to form a second linear alkylbenzene stream;

combining the first linear alkylbenzene stream and the second linear alkylbenzene stream form a third linear alkylbenzene stream, as well as the product made from this process.

In another broad respect, this invention is a process useful for the production of linear alkylbenzene, comprising:

combining a product from a conventional linear alkylbenzene alkylation reactor with a product from a linear alkylbenzene alkylation reactor containing fluorine-containing mordenite.

In yet another broad respect, this invention is a process for the production of linear alkylbenzene, comprising:

dehydrogenating a paraffin to form an olefin;

sending a primary feed stream of benzene and the olefin through a conduit to a conventional linear alkylbenzene alkylation reactor;

contacting the primary feed stream in the conventional linear alkylbenzene alkylation reactor with a conventional linear alkylbenzene alkylation catalyst under conditions effective to react the benzene and olefin to form a first linear alkylbenzene product;

withdrawing a portion of the primary feed stream from the conduit and contacting the portion with a fluorine-containing mordenite under conditions effective to react the benzene and olefin to form a second linear alkylbenzene product;

combining the first and second linear alkylbenzene products to form a crude linear alkylbenzene stream;

distilling the crude linear alkylbenzene stream in a first distillation column to separate benzene that did not react and to form a benzene-free linear alkylbenzene stream;

optionally distilling the benzene-free linear alkylbenzene stream in a second distillation column to separate any olefin and to form a linear alkylbenzene stream;

distilling the second olefin free alkylbenzene stream in a third distillation column to provide an overhead of a purified linear alkylbenzene product and removing a bottoms stream containing any heavies.

The fluorine treated mordenite catalyst advantageously produces high selectivities to the 2-phenyl isomer in the preparation of LAB, generally producing selectivities of about 70 percent or more. Also, the fluorine treated mordenite enjoys a long lifetime, preferably experiencing only a 25 percent or less decrease in activity after 400 hours on stream. A process operated in accordance with the apparatus depicted in FIGS. 1 and 2 has the advantage that rising benzene from the reboiler continuously cleans the catalyst to thereby increase lifetime of the catalyst. In addition, this invention advantageously produces only low amounts of dialkylated benzene, which is not particularly as useful for detergent manufacture, as well as only low amounts of tetralin derivatives.

Use of the process and system of this invention for alkylation of aromatics with long chain olefins, particularly .alpha.-olefins, or long chain olefin/paraffin mixed feed stocks advantageously achieves high conversion rates and long catalyst lifetimes by using the reactor configuration specified above. When the process and system of this invention is used for selective benzene monoalkylation by liquid olefin or liquid olefin/paraffin mixed feed stocks, high selectivity to 2-phenyl product isomers is advantageously obtained. Additional benefits may be derived from the process and system of this invention by utilizing a column of solid acid catalyst and a water condenser with water take-off above the catalyst bed as depicted, for instance, in FIG. 1 and FIG. 2. A process operated in accordance with the representative apparatus of this invention depicted in FIG. 1 and FIG. 2 has the advantage that rising benzene vapor from the reboiler continuously cleans the catalyst of heavy organics to thereby increase lifetime of the catalyst. Improved catalyst life and performance during benzene alkylation is enhanced by continuous water removal from the catalyst bed (without the need for a predrying step) and by better mixing of the reactants and increased effective benzene concentration in the alkylation reaction zone. In addition, when used for selective benzene monoalkylation this invention advantageously produces only low amounts of dialkylated benzene, which is not particularly as useful for detergent manufacture, as well as only low amounts of tetralin derivatives.

Certain terms and phrases have the following meanings as used herein.

"Meq/g" means milliequivalents of titratable acid per gram of catalyst, which is a unit used to describe acidity of the catalysts. Acidity is generally determined by titration with a base, as by adding excessive base, such as sodium hydroxide, to the catalyst and then back titrating the catalyst.

"Conv." and "Conversion" mean the mole percentage of a given reactant converted to product. Generally, olefin conversion is about 95 percent or more in the practice of this invention.

"Sel." and "Selectivity" mean the mole percentage of a particular component in the product. Generally, selectivity to the 2-phenyl isomer is about 70 or more in the practice of this invention.

The mordenite catalyst of the present invention is useful as a catalyst in the production of LAB's in accordance with the process of manufacturing LAB's of this invention. LAB is useful as starting material to produce sulfonated LAB, which itself is useful as a surfactant.

DETAILED DESCRIPTION OF THE INVENTION

Catalyst Preparation and Properties

Figure 1:
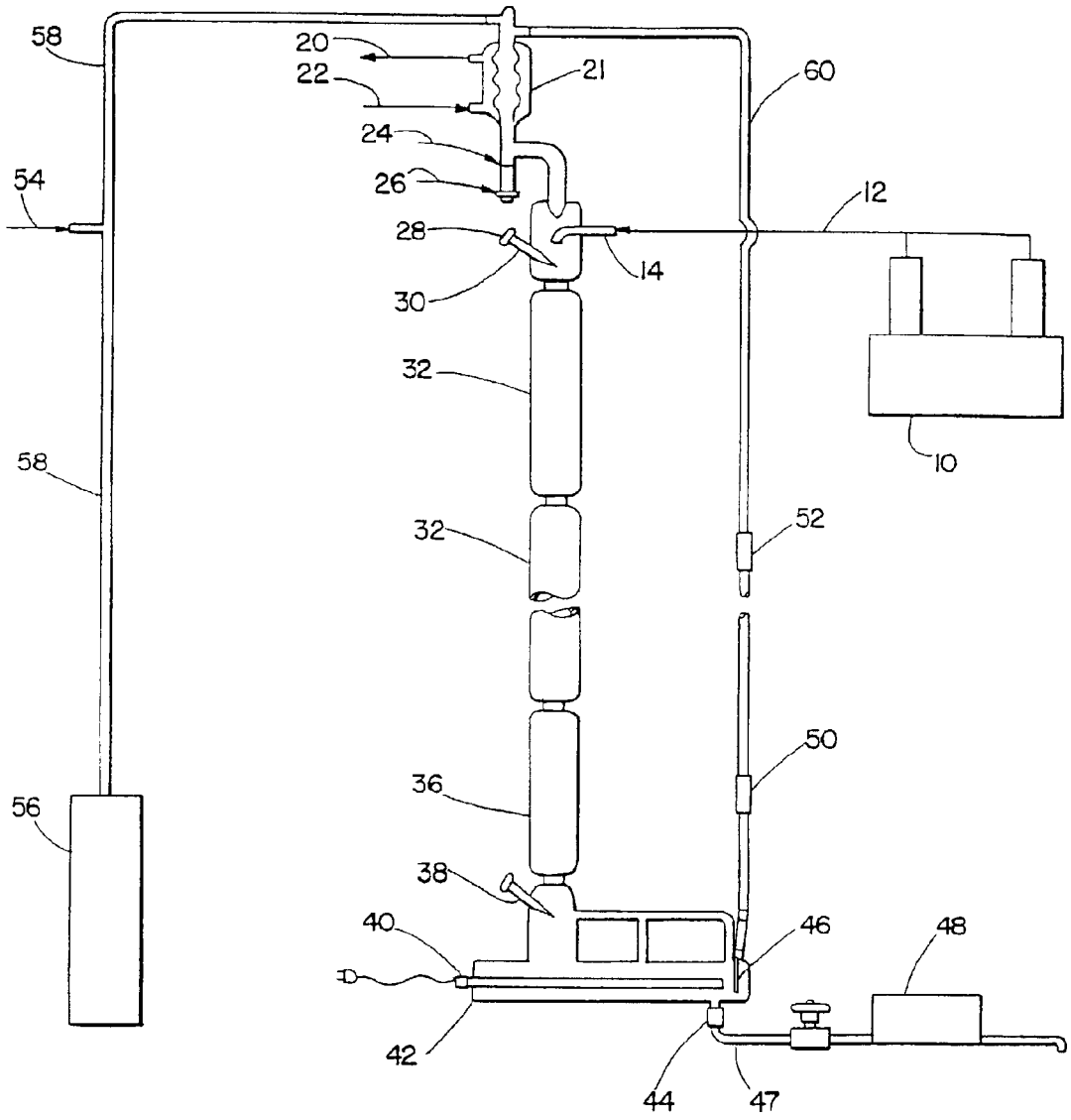
FIG. 1 shows a representation of a first continuous reactive distillation column employed in the practice of this invention.

The catalyst of this invention is a fluorine-containing mordenite. Mordenite is a type of zeolite. The catalyst of this invention is prepared from hydrogen mordenite (typically having 0.1 percent or less of sodium) having a silica-alumina molar ratio of from about 10:1 to about 100:1. More typically, the starting mordenite has a silica/alumina molar ratio of from about 10:1 to about 50:1. The starting hydrogen mordenite, which is commonly available commercially, is treated with an aqueous solution of hydrogen fluoride ("HF") to produce the active, long-life and highly selective catalyst of the invention. In the course of such HF treatment, as well as during subsequent calcination of said HF-treated mordenite, the silica/alumina molar ratio typically increases. The finished catalysts of this invention show a fluorine content of from about 0.1 to about 4 percent by weight, more typically about 1 percent.

While not wishing to be bound by theory, it is believed that the HF reacts with sites where —Si—O—Al— linkages occur such that the linkage is broken with fluorine becoming bonded to the Al such that —Si—OH and F—Al— groups form. This is believed to decrease the total Bronsted acid sites and increase the strength of the remaining acid sites in the mordenite and is believed to stabilize the acidity of the mordenite such that the mechanisms which degrade performance during LAB production, such as coke build-up, are retarded.

The aqueous solution used to treat the mordenite may contain a range of HF concentrations. Generally, the HF concentration is a minimum of about 0.1 percent by weight. Below such minimum concentration, the effect of the fluorine treatment significantly decreases, resulting in the undesirable need for repeated treatments. Generally, the HF concentration on the upper end is about 10 percent by weight or less. Above a concentration of about 10 percent by weight, the HF is so concentrated that it is difficult to prevent HF from destroying the crystallinity of the mordenite, thereby detrimentally affecting its efficacy as a catalyst for LAB production.

The aqueous HF solution may be prepared by diluting commercially available 48% HF solutions to the desired concentration. Alternatively, HF can be sparged into water to provide an aqueous HF solution.

Typically, the treatment is carried out by adding mordenite powder or pellets to a stirred aqueous ET solution at a temperature of from about 0° C. to about 50° C. The stirring and contacting is continued for a time sufficient to achieve the desired level of fluorine in the mordenite. This time may vary depending on factors such as HF concentration, amount of BY solution relative to the amount of mordenite being treated, speed of agitation is employed, and temperature. After treatment, the mordenite can be recovered by filtration, and then dried. It is also possible to impregnate the mordenite to incipient wetness with a given HF solution, as well as to treat the mordenite with gaseous hydrogen fluoride. Preferably said fluoride-treated mordenite would be calcined in air prior to use in alkylation service. The preferred calcination temperature would be in the range from about 400° C. to about 600° C. Alternative mordenite fluorinating agents to hydrofluoric acid and hydrogen fluoride include ammonium fluoride, fluorided silicon compounds and fluorided hydrocarbons.

The HF-treated mordenite of this invention generally has about 0.1 percent by weight or more of fluorine based on the total weight of the mordenite. Typically, the fluorine-containing mordenite contains about 4 percent by weight or less fluorine. The fluorine-containing mordenite most typically contains about 1 percent by weight of fluorine.

The mordenite can be used in the practice of this invention as a powder, in pellet form, as granules, or as extrudates. The mordenite can be formed into pellets or extrudates using binders well known to those of skill in the art, such as alumina, silica or mixtures thereof.

When used with this invention, fluorine treated mordenite catalyst advantageously produces high selectivities to the 2-phenyl isomer in the preparation of LAB, generally producing selectivities of about 70 percent or more. Also, when used in the apparatus of this invention, the fluorine treated mordenite enjoys a long lifetime, preferably experiencing only a 25 percent or less of a decrease in activity after 400 hours on stream.

Catalysts that may be employed in the practice of this invention include any solid acid alkylation catalyst. Representative examples of such solid catalysts include acidic zeolitic materials such as acidic y-zeolites, .beta.-zeolites, acidic mordenites, acidic clays (particularly acidic montmorillonite clays), fluorided montmorillonite clays, fluorided .beta.-zeolites, fluorided mordenites and silica-alumina combinations among others. Other catalysts that may be employed in the practice of this invention include those comprising a heteropoly acid, mineral acid, or phosphoric acid in combination with zeolite or non-zeolite solid inorganic oxide supports, large pore crystalline molecular sieve and/or ion exchange resin, as well as mineral acid and carboxylic acid treated zeolites, such as mordenites.

Acidic zeolites that may be employed in the process and system of this invention include both naturally occurring and synthetic silica-alumina zeolites. Acceptable acidic zeolites are characterized as being preferably dealuminized or as having a reduced alkali metal content and include those based on A, X, Y, and L type zeolites, erionite, omega, beta, and mordenite. Other acceptable acidic molecular sieve catalysts include any of the various types of mole sieves having reduced alkali metal content. Preferred acidic zeolites for this invention are .beta.-zeolite and dealuminated mordenite.

The non-zeolitic solid inorganic oxide that may be employed with a Bronsted or Lewis acid in the process and system of this invention may be selected from among the inorganic oxides including alumina, silica, boria, titanium dioxide, zirconium dioxide, chromia, zinc oxide, magnesia, calcium oxide, silica-alumina, silica-magnesia, silica-alumina-magnesia, silica-alumina-zirconia, chromia-alumina, alumina-boria, silica-zirconia, etc. and the various naturally occurring inorganic oxides of various states of purity such as bauxite, clay, diatomaceous earth, etc. The preferred inorganic oxide is a solid acid montmorillonite catalyst, particularly an acidic fluorided montmorillonite clay.

The large and medium pore crystalline zeolites that may be employed with a Bronsted or Lewis acid in the process and system or this invention include zeolites such as ZSM-5, ZSM-12, ZSM-18, ZSM-20, zeolite Beta, zeolite L, mordenite, faujasite, zeolite Y, zeolite X and the rare earth metal-containing forms of the above.

Other large pore ordered structures which can be used with a Bronsted or Lewis acid in the present invention include pillared silicates and/or clays; aluminophosphates, e.g. ALPO-5, VPI-5; silicoaluminophosphates, e.g. SAPO-5, SAPO-37, SAPO-31, SAPO-40, SAPO-41; as well as other metal aluminophosphates.

The ion exchange resins that may be employed in the process and system of the present invention include those macroreticular acid ion exchange resins having sulfonic acid groups, e.g., the sulfonated styrene-divinylbenzene copolymer exchange resins such as those commercially available as Amberlyst-15, Amberlyst XN-1005, Amberlyst XN-1010, Amberlyst XN-1011, Amberlyst XN-1008 and Amberlite 200. Microreticular acid ion exchange resins, such as Amberlite IR-120H may also be acceptable in the practice of this invention.

Reactants for LAB Production

In the practice of this invention, benzene is alkylated with olefin to form LAB. These reactants can be handled and purified as is generally performed by those of skill in the art. In this regard, it is preferred that the reactants are water and alcohol free. The olefins employed in the practice of this invention have from about 8 to about 30 carbons, preferably from about 10 to about 14 carbons, such as is available commercially or produced as dehydrogenated paraffin feed stocks. It is preferred that the olefin be monounsaturated. It is most preferred that the olefin be an alpha-olefin containing a terminal ethylenic unit.

Commonly, said olefins would be available in a paraffinic media of the same carbon range. Olefins in the 10 to 14 carbon number range would typically be available from $C_{-10}$ to $C_{-14}$ paraffin dehydrogenation in a $C_{-10}$ to $C_{-14}$ paraffin mixture having an olefin content of 5 to 20%. Often, the olefin content of said olefin-paraffin mixture would be 8 to 10 weight %.

The 2-phenyl isomer of the LAB produced in accordance with this invention is of formula:

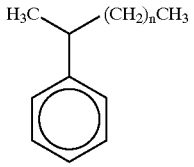

wherein n is from about 5 to about 17 and preferably from about 7 to about 11.

Process Conditions, Procedures, and Apparatus

The process of this invention can be carried out using the continuous reactive distillation column depicted in FIG. 1. In FIG. 1, a feed mixture of benzene and olefin, generally at a benzene-to-olefin molar ratio range of about 1:1 to 100:1 flows from feed pump 10 to feed inlet 14 via line 12. The feed mixture falls to packed mordenite catalyst bed 32 where alkylation in the presence of the fluorine-containing mordenite occurs. Alternatively, while not depicted in FIG. 1, the benzene and olefin can be introduced separately into the bed with mixing occurring in the bed, or the reactants can be mixed via an in-line mixer prior to introducing the reactants into the catalyst bed, or the reactants can be injected separately above the bed with mixing affected by use of standard packing above the bed, or the reactants can be sparged into the chamber above the bed. Because of the lack of affinity between liquid aromatics and olefins, mixing of the liquid reactants is important to achieve good conversion. Therefore, to achieve good conversion when the reactants are injected separately it is especially important to provide for mixing within the reactor.

The catalyst bed 32 depicted in FIG. 1 for laboratory scale may be made of two lengths of 1.1 inch internal diameter tubing, the lengths being 9.5 inches and 22 inches. In the catalyst bed 32, the falling feed mixture also contacts rising vapors of unreacted benzene which has been heated to reflux in reboiler 42 by heater 40. Such rising vapors pass over thermocouple 38 which monitors temperature to provide feedback to heater 40. The rising vapors of benzene and/or olefin also pass through standard packing 36 (e.g., 7.5 inches of goodloe packing). The rising vapors heat thermocouple 30 which connects to bottoms temperature controller 28 which activates heater 40 when temperature drops below a set level. Acceptable catalyst distillation structures for use in the process and system of the present invention include, stars, doughnuts, and spheres. Preferred catalyst distillation structures are extrudates, tablets, and granules.

Prior to startup, the system may be flushed with nitrogen which enters via line 54 and which flows through line 58. After startup, a nitrogen blanket is maintained over the system. Also prior to startup and during nitrogen flush, it may be desirable to heat catalyst bed 32 so as to drive off water from the fluorine-containing mordenite.

Residual water from the feed mixture or which otherwise enters the system is collected in water trap 24 upon being liquified at condenser 21 (along with benzene vapor). If the feed is very dry (free of water) the water trap 24 may not be needed. Removing water leads to longer catalyst lifetime. Hence, the water trap 24 is optional. The same applies to FIG. 2. Condenser 21 is cooled via coolant such as water entering condenser 21 via port 22 and exiting via port 20. As needed, water in water trap 24 may be drained by opening drain valve 26.

As needed, when LAB content in reboiler 42 rises to a desired level, the bottoms LAB product may be removed from the system via line 47, using either gravity or bottoms pump 48 to withdraw the product. When product is so withdrawn, valve 44 is opened.

In FIG. 1, dip tube 46, which is optional, is employed to slightly increase the pressure in reboiler 42 to thereby raise the boiling point of benzene a degree or two. Likewise, a pressure generator 56 may be optionally employed to raise the pressure of the system. Other standard pressure increasing devices can be employed. Pressure can thus be increased in the system such that the boiling point of benzene increases up to about 200° C.

In FIG. 1, control mechanisms for heat shutoff 50 and pump shutoff 52 are depicted which serve to shut off heat and pump if the liquids level in the system rises to such levels. These control mechanisms are optional and may be included so that the catalyst bed does not come into contact with the bottoms of the reboiler. Line 60 connects pump shutoff 52 to the system above condenser 21.

Figure 2:
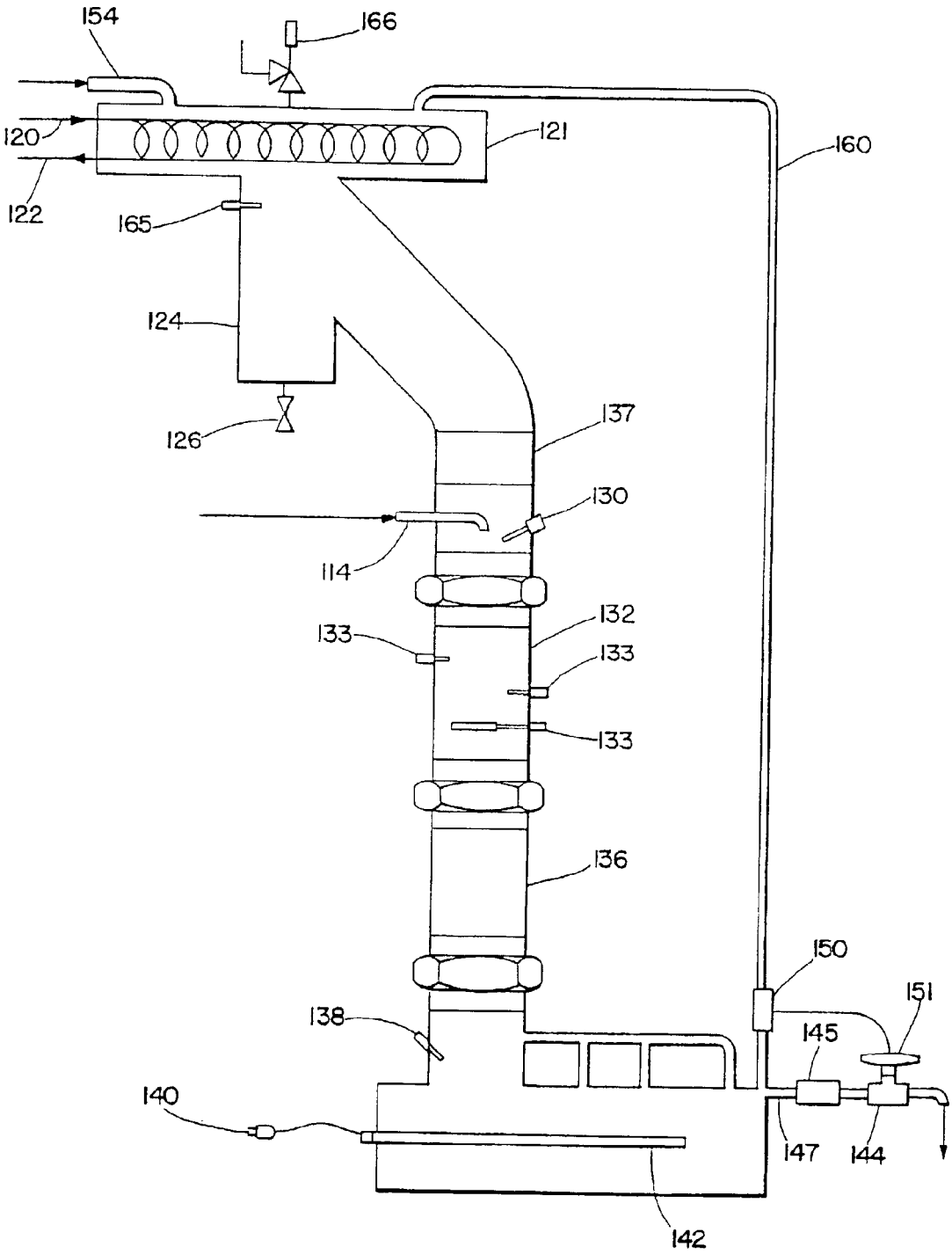
FIG. 2 shows a representation of a second continuous reactive distillation column employed in the practice of this invention.

In the practice of this invention in the alkylation of benzene, a wide variety of process conditions can be employed. In this regard, the temperature in the catalyst bed may vary depending on reactants, rate of introduction into the catalyst bed, size of the bed, and so forth. Generally, the bed is maintained at the reflux temperature of benzene depending on pressure. Typically, the temperature of the catalyst bed is above about 70° C., and most likely about 78° C. or more in order to have reasonable reaction rates, and about 200° C. or less to avoid degradation of reactants and products and to avoid deactivation of the catalyst by coke build-up. Preferably, the temperature is in the range from about 80° C. to about 140° C. The process may be operated at a variety of pressures during the contacting step, with pressures of about atmospheric most typically being employed. When the process is operated using a system as depicted in FIGS. 1 and 2, the reboiler temperature is maintained such that benzene and olefin vaporize, the temperature varying depending on olefin, and generally being from about 80° C. to about 250° C. for olefins having 10 to 14 carbons. The composition of the reboiler will vary over time, but is generally set initially to have a benzene olefin ratio of about 5:1, with this ratio being maintained during the practice of this invention. The rate of introduction of feed into the catalyst bed may vary, and is generally at a liquid hourly space velocity ("LHSV") of about 0.05 $hr^{-1}$ to about 10 $hr^{-1}$, more typically from about 0.05 $hr^{-1}$ to about 1 $hr^{-1}$. The mole ratio of benzene to olefin introduced into the catalyst bed is generally from about 1:1 to about 100:1. In commercial benzene alkylation operations, it is common to run at mole ratios of from about 2:1 to about 20:1, which can suitably be employed in the practice of this invention, and to charge said olefins as an olefin-paraffin mixture comprising 5% to 20% olefin content. Said olefin-paraffin mixtures are normally generated commercially through dehydrogenation of the corresponding paraffin starting material over a noble metal catalyst.

Another continuous reactive distillation apparatus is depicted in FIG. 2. In FIG. 2, the feed mixture enters the reactor via feed inlet 114. The feed mixture falls through the column into catalyst bed 132, wherein alkylation to form LAB occurs. A thermowell 133 monitors the temperature of said catalyst bed 132. The catalyst bed 132 may be optionally heated externally and is contained within 1¼ inch stainless steel tubing. Goodloe packing is positioned at packing 136 and 137. LAB product, as well as unreacted benzene and olefin, fall through packing 136 into reboiler 142. In reboiler 142, electric heater 140 heats the contents of reboiler 142 such that heated vapors of benzene and olefin rise from the reboiler 142 to at least reach catalyst bed 132. As needed, the bottoms LAB product may be removed from reboiler 142 by opening bottoms valve 144 after passing through line 147 and filter 145. Residual water from the feed mixture, or which otherwise enters the system, may be condensed at condenser 121 which is cooled with coolant via inlet line 120 and exit line 122. The condensed water falls to water trap 124, which can be drained as needed by opening drain valve 126. Temperature in the system is monitored via thermocouples 138, 130, and 165. The system includes pressure release valve 166. A nitrogen blanket over the system is maintained by introduction of nitrogen gas via inlet line 154. Level control activator 150 activates bottoms level control valve 151 to open when the liquids level in the reboiler rises to the level control activator 150. Line 160 connects level control activator 150 to the system above condensor 121. In this embodiment, the catalyst distillation structure preferably may comprise any of extrudates, granules, or tablets.

While the systems depicted in FIG. 1 and FIG. 2 show single catalyst bed systems, it may be appreciated that multi-catalyst bed reactors are within the scope of this invention, as well as multiple ports for inlet feeds, water traps, product removal lines, and so forth. Moreover, the process may be run in batch mode, or in other continuous processes using plugflow designs, trickle bed designs, and fluidized bed designs.

It is believed that as average molecular weight of olefins increases, particularly when the average number of carbons exceed 14, the selectivity and conversion to LAB, especially LAB with the 2-isomer, may incrementally decrease. If desired, the product of the alkylation using HF-treated mordenite may be sent to a second, finishing catalyst bed to improve yield. This procedure is optional and is believed to be dependent on the needs and desires of the end user. An example of such a second catalyst is HF-treated clay such as montmorillonite clay having about 0.5% fluoride. Such a catalyst may also serve to lower the bromine number below about 0.1, depending on conditions.

Variable 2-phenyl Isomer Content of Product Using the Mordenite of this Invention in Combination with a Second, Solid LAB Alkylation Catalyst The fluorine-containing mordenite of this invention generally produces LAB having high 2-phenyl isomer content, such as higher than about 70%. Currently, LAB purchasers who make detergents would prefer to use LAB having a 2-phenyl isomer content in the range from about 30 to about 40 percent, but this level is not available in the marketplace. Conventional LAB alkylation technology does not, however, achieve these higher 2-phenyl isomer levels. HF, for instance, produces about 16–18 percent of the 2-phenyl isomer in the product stream from the reactor. Aluminum chloride, on the other hand, produces 26–28 percent of the 2-phenyl isomer in LAB. The present inventors recognized that a need exists for a process which produces a 2-phenyl isomer product in the desired range.

It has now been found that the mordenite of this invention can be used in combination with conventional solid LAB alkylation catalysts, such as HF, silica-alumina (with or without fluorine treatment, such as disclosed in U.S. Pat. No. 5,196,574), clay and aluminum chloride. This may be affected by withdrawing a slip stream of reactant that is being sent to the conventional LAB reactor, and directing the slip stream to the mordenite reactor. Since conventional LAB alkylation catalysts produce product having a 2-phenyl isomer content much less than that from the mordenite of this invention, combining the products from each catalyst results in a product having a higher 2-phenyl isomer content than that from the conventional LAB alkylation catalyst. For example, while the catalyst of this invention typically produces a 2-phenyl isomer content of 70% or more, a typical HF process produces about 16–18% of the 2-phenyl isomer. By combining effluent from each catalyst at given proportions, the resulting mixture will have any desired 2-phenyl isomer contant in the range between the 2-phenyl isomer contents of the HF catalyst product and the mordenite catalyst product. Thus, the levels of 2-phenyl isomer may be adjusted by the amount of reactants sent to the mordenite catalyst and/or by storing 2-phenyl isomer product from the mordenite catalyst for later mixing with the product from the conventional LAB alkylation catalyst to thereby achieve any desired level of 2-phenyl isomer content in the final product. An advantage of this invention pertains to the ability to retrofit an existing, conventional LAB system with a reactor containing fluorine-treated mordenite of this invention. This enables existing users of the conventional LAB technology to augment their existing facilities without interrupting their production. This provides a considerable cost advantage to the producer.

The conventional LAB catalysts used most frequently are HE alkylation reactors and aluminum chloride alkylation catalysts. Other alkylation catalysts include various zeolites, alumina-silica, various clays, as well as other catalysts.

Figure 3:
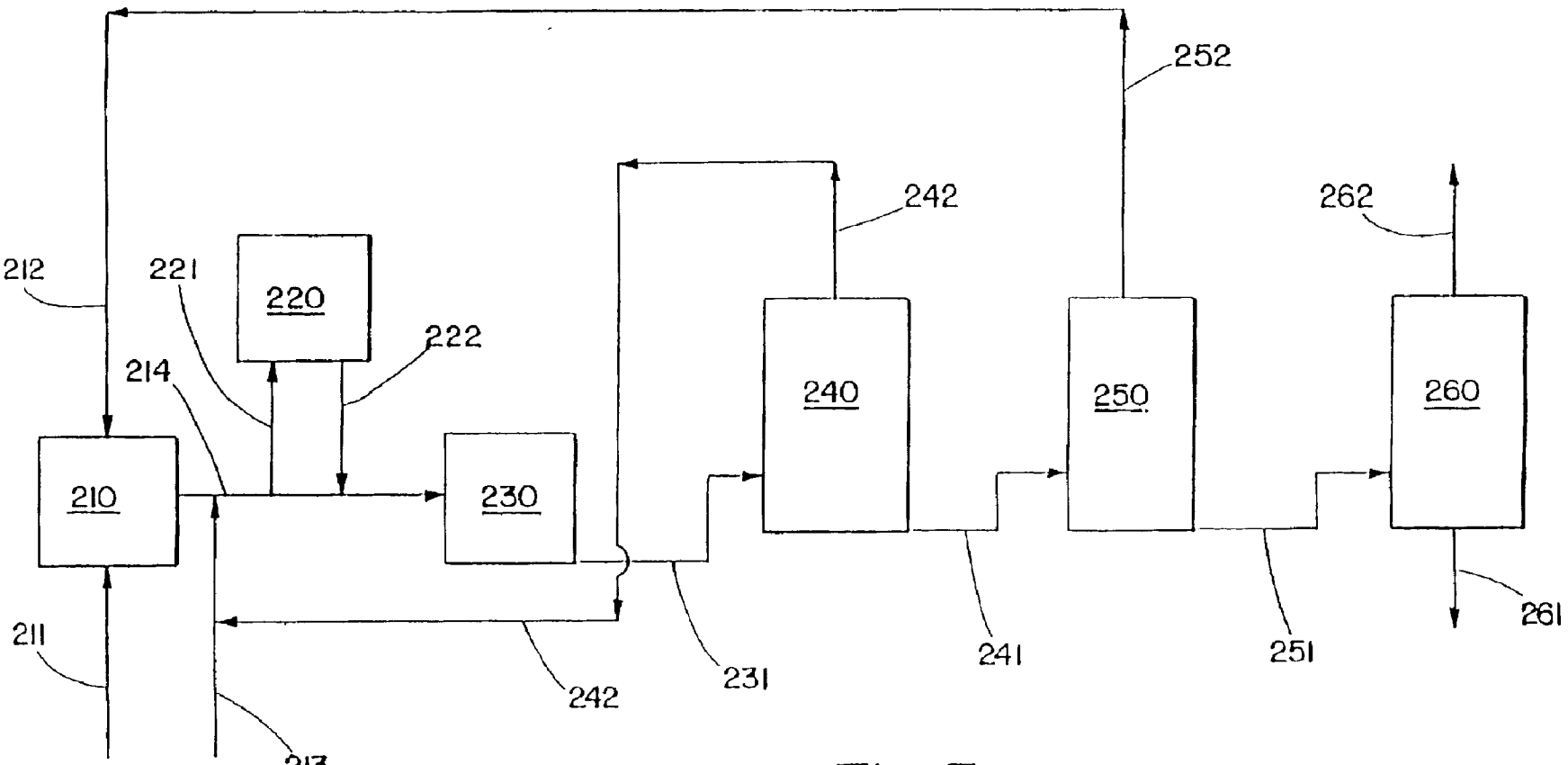
FIG. 3 shows a representative process scheme for one embodiment of this invention where a fluorine-containing mordenite is employed with a second, solid catalyst to achieve variable 2-phenyl isomer content depending on the relative proportions of the two catalysts. The depiction in FIG. 3 may also represent a conventional LAB alkylation reactor shown in combination with a fluorine-containing mordenite reactor of this invention wherein a slip stream of reactant to the conventional reactor is sent to the mordenite reactor and wherein the flow of high 2-phenyl isomer LAB from the mordenite reactor may be adjusted to vary the 2-phenyl isomer LAB content of the effluent from the conventional LAB alkylation reactor.

FIG. 3 depicts a representative, non-limiting scheme for the practice of this invention. The catalysts, which may be used as a mixture, may be packed in series in the reactor 230 or may be loaded into two reactors aligned in series, are employed in amounts effective to achieve the desired level of 2-phenyl isomer content. If the catalysts are employed in series, whether in the same reactor or in multiple reactors, the amount of the first catalyst in the series is an amount relative to the amount and/or flow rate of the reactants that is insufficient to effect complete conversion of the reactants. The second catalyst may be used in any amount which will complete reaction of the reactants. The fluorine-containing mordenite may be either the first or second catalyst, preferably being in the first bed. Alternatively, reactor 230 may be packed with a mixed bed of the two catalysts.

The scheme of FIG. 3 is shown in the context of LAB alkylation based on a feed from a paraffin dehydrogenation facility. Thus, in FIG. 3 fresh paraffin is fed to a conventional dehydrogenation apparatus 210 via line 211, with recycled paraffin being introduced from the paraffin column 250 via line 252. Dehydrogenated paraffin from the dehydrogenation apparatus 210 is then pumped into an alkylation reactor (or reactors) 230 that contains the fluorine-containing mordenite and a second, solid alkylation catalyst. The dehydrogenated paraffin feed may of course be supplied from any provider. The source of dehydrogenated paraffin (olefin) is not critical to the practice of this invention. LAB product from alkylation unit 230 may thereafter be purified by a series of distillation towers.

In this regard, alkylation effluent may be delivered to a benzene column 240 by way of line 231. It should be appreciated that the alkylation product may be sent offsite for purification. Further, the particular purification scheme used is not critical to the practice of this invention. The scheme depicted in FIG. 3 is instead representative of a typical commercial operation. In FIG. 3, unreacted benzene is distilled off from the crude LAB product. Benzene is then recycled to the alkylation reactor 230. The benzene-free LAB crude product from the benzene column 240 is pumped through line 241 to paraffin column 250 where any paraffin present is distilled off, with the distilled paraffin being recycled to paraffin dehydrogenation unit 210 via line 252. Paraffin-free crude LAB from the paraffin column 250 is transported to a refining column 260 where purified LAB is distilled and removed via line 262. Heavies (e.g., dialkylates and olefin derivatives) are withdrawn from refining column 260 via conduit 261.

It should be appreciated that columns 240, 250, and 260 may be maintained at conditions (e.g., pressure and temperature) well known to those of skill in the art and may be parked with conventional materials if desired.

The conventional LAB catalysts used most frequently are HF alkylation catalysts and aluminum chloride alkylation catalysts. Other alkylation catalysts in use today include, various zeolites, alumina-silica, various clays, as well as other catalysts.

Alternately, FIG. 3 can depict a representative, non-limiting scheme for practice of this invention wherein the fluorine-treated mordenite is used in combination with a HF alkylation reactor to afford LAB having high 2-phenyl isomer contents relative to that produced from the HF reactor alone. The scheme of FIG. 3 in such use is shown to be understood in this regard in the context of LAB alkylation based on a feed from a paraffin dehydrogenation facility. Prior to this invention, the plant depicted in FIG. 3 would be operated conventionally without use of mordenite reactor 220.

Thus, in conventional operation, fresh paraffin is fed to conventional dehydrogenation apparatus 210 via line 211, with recycled paraffin being introduced from the paraffin column 250 via line 252. Dehydrogenated paraffin from the dehydrogenation apparatus 210 is then pumped into a conventional alkylation reactor 230 containing conventional LAB catalyst, such as HF, via conduit 214. The dehydrogenated paraffin feed may of course be supplied from any provider. The source of dehydrogenated paraffin (olefin) is not critical to the practice of this invention. LAB product from alkylation unit 230 may thereafter be purified by a series of distillation towers.

In this regard, alkylation effluent is delivered to a benzene column 240 by way of line 231. It should be appreciated that the alkylation product may be sent offsite for purification. Further, the particular purification scheme used is not critical to the practice of this invention, but is depicted in FIG. 3 as representative of a typical commercial operation. In FIG. 3, unreacted benzene is distilled off from the crude LAB product. Benzene is then recycled to the alkylation reactor 230. The benzene-free LAB crude product from the benzene column 240 is pumped through line 241 to olefin column 250 where any olefin present is distilled off, with the distilled olefin being recycled to paraffin dehydrogenation unit 210 via line 252. Olefin-free crude LAB alkylate from the olefin column 250 is transported to a refining column 260 where purified LAB is distilled and removed via line 262. Heavies (e.g., dialkylates and olefin derivatives) are withdrawn from refining column 260 via conduit 261.

In the practice of this invention, a fluorine-treated mordenite containing reactor 220 is used in conjunction with the conventional alkylation reactor 230. In the embodiment of this invention depicted in FIG. 3, a slip stream of benzene/dehydrogenated paraffin feed is taken from line 214 and pumped through mordenite reactor 220 where high 2-phenyl isomer production is achieved. LAB product from reactor 220, high in 2-phenyl isomer, is then introduced back into line 214 via line 222. Alternatively mordenite reactor 220 may be fed benzene and dehydrogenated paraffin (olefin) directly, rather than by way of a slip stream from line 221. In addition, effluent from reactor 220 may, in the alternative if no unreacted olefin is present, be sent directly to benzene column 240, for later combination with conventional alkylation reactor 230 product or transported and tied into conduit 231, which feeds benzene column 240. It should be appreciated that columns 240, 250, and 260 may be maintained at conditions (e.g., pressure and temperature) well known to those of skill in the art and may be packed with conventional materials if desired.

Figure 4:
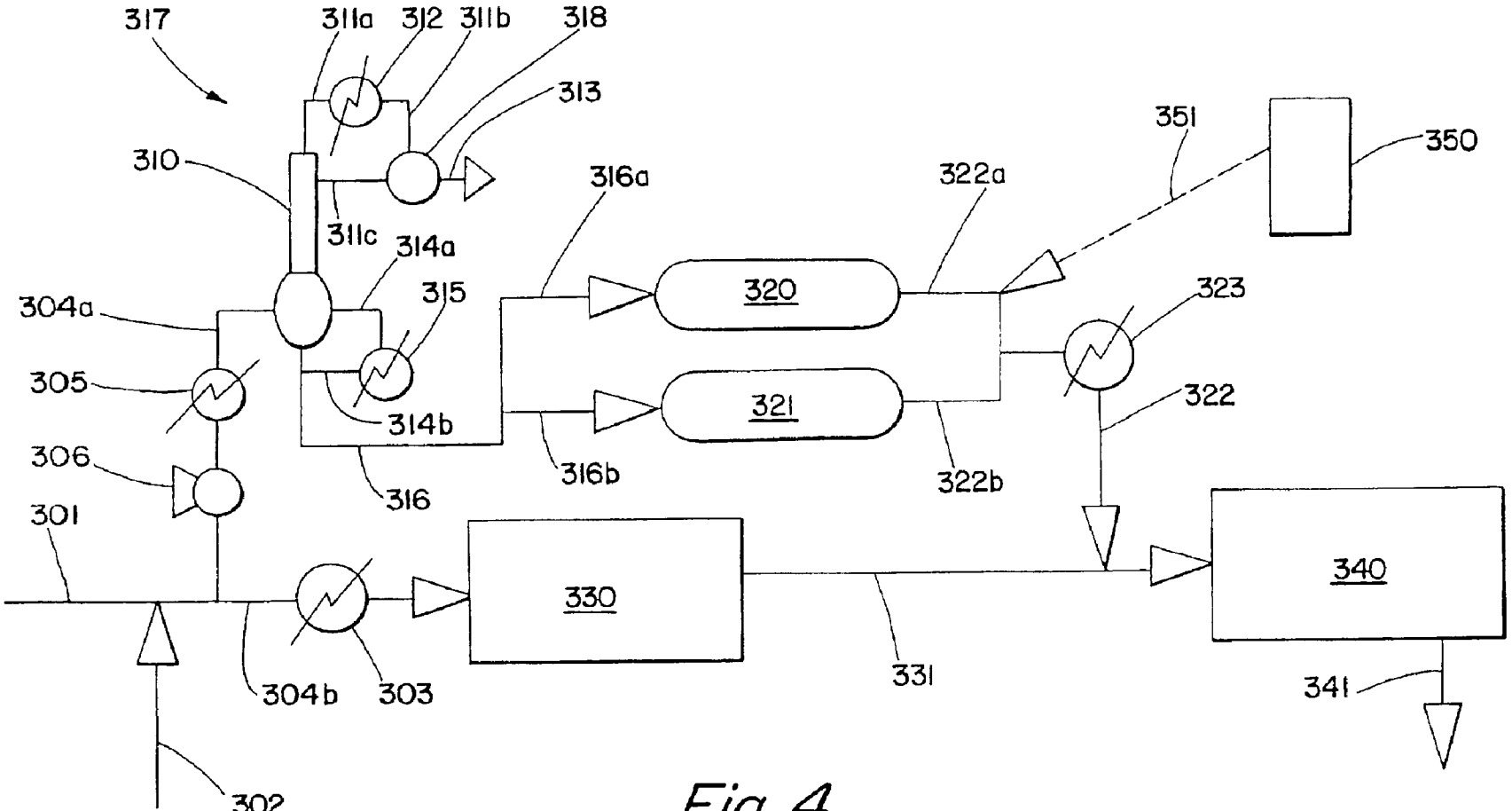
FIG. 4 shows another representative process scheme for one embodiment of this invention where a first conventional LAB alkylation reactor is shown in combination with a fluorine-containing mordenite reactors of this invention wherein a slip stream of reactant to the conventional reactor is sent to one or both of a pair of mordenite reactor and wherein the effluent from the first LAB alkylation reactor and the effluent from the one or both mordenite reactors are combined and flowed into a second conventional LAB alkylation reactor.

FIG. 4 depicts an alternative configuration to that shown in FIG. 3. In FIG. 4, dual mordenite beds 320, 321 are used in conjunction with conventional alkylation reactors 330, 340. Conveniently, one of the mordenite reactors may be in operation while the other reactor is down for catalyst regeneration. For example, during operation, olefin feed (dehydrogenated paraffin) is supplied via line 301, with benzene or other aromatic feed stock being provided via line 302. The admixed reactants may flow to standard alkylation reactor 330 via line **304*b* after passing through heat exchanger 303. A portion of the mixed stream may be withdrawn via line 304*a* for supply to the mordenite reactor. The extent of the mixed feed stream being withdrawn may be varied depending on the desired level of 2-phenyl isomer in the final product. In another embodiment, the product from the reactor containing mordenite 320, 321 may be fed to the first alkylation reactor 330, particularly if the second alkylation reactor 34** is not employed in the process.

The slip stream reactants may optionally be sent to dewatering unit 317 by application of pump 306 after passing through heat exchanger 305. In the dewatering unit 317, water is distilled from the reactants in dewatering tower 310. Rising vapor exits via line **311*a* and passes through heat exchanger 312 wherein condensation occurs. Effluent from heat exchanger 312 is advanced to water trap 318 via line 311*b*. Water is removed from water trap 318 via line 313, with the bottom organic layer being returned to the dewatering tower 310. Dewatered reactants may be removed via line 316 and conveyed to either line 316*a* or line 316*b*. Some of the dewatered reactant may be withdrawn by conduit 314*b*, sent through heat exchanger 315 and returned to the tower 310 via line 314*a*. In this regard, heat exchanger 315** may serve as a reboiler.

After reaction in either reactor 320 or 321, LAB product is sent to lines 322 and 331 from either line **322*a* or 322*b* after passing through heat exchanger 323. When desired, one of the catalyst beds may be regenerated, as by calcination for example, through use of regeneration heater 350, which may be connected to the reactor of choice by dotted line 351 through valving and hardware that are not shown. The reactors 320 and 321 may optionally be run simultaneously. The reactors 320 and 321 may be loaded with mordenite catalyst in any fashion, as would be apparent to one of skill in the art. Typically, a plugged flow arrangement is used. The amount of catalyst employed may vary depending on a variety of considerations such as type and flow rate of reactants, temperature and other variables. The combined effluents from conventional reactor 330 and mordenite reactors 320 or 321 may be fed to a second conventional reactor 340, or optionally may be sent to a purification section directly if no unreacted paraffin is present (the conventional reactor serves to complete reaction of any paraffin that is not converted in the mordenite reactors 320, 321). In FIG. 4, effluent from the second conventional alkylation reactor is advanced to a purification section. The second alkylation reactor may be used to react unreacted feed stock from reactors 330, 320 and 321** to thereby reduce recycle loads.

It should be appreciated that a wide variety of configurations are contemplated, and the figures should not be construed as limiting this invention or claims hereto. Additional reactors and other equipment may, for example, be used.

REPRESENTATIVE EXAMPLES

The following examples are illustrative of the present invention and are not intended to be construed as limiting the scope of the invention or the claims. Unless otherwise indicated, all percentages are by weight. In the examples, all reactants were commercial grades and used as received. The apparatus depicted in FIG. 1 was employed for most of the examples, including examples 2–4. The equipment of FIG. 2 was used in Examples 20, 21, 26 and comparative Example 2.

It may be noted that example 2 illustrates LAB production from paraffin dehydrogenate using the fluoride-treated mordenite catalyst of example B, where good catalyst life (250+ hrs) is achieved without catalyst regeneration, while maintaining a 2-phenyl LAB selectivity of >70% and high LAB productivity without significant loss of fluoride. Comparative example 1, on the other hand, using untreated mordenite, with no fluoride added, shows a rapid decline in LAB production. In addition, examples 3 and 4 illustrate LAB production using a 5:1 molar benzene/$C_{10}$–$C_{14}$ olefin feed mix and the fluoride-treated mordenite catalysts of Example B when operating at different LHSV's in the range of 0.2–0.4 $hr^{-1}$. Catalyst life may exceed 500 hours. Example 5 illustrates LAB production with the fluoride-treated mordenite catalyst where the alkylation is conducted at higher temperatures and under pressure. Examples 6–8 illustrate the performance of three HF-treated mordenite catalysts with different fluoride loadings. Example 9 shows how virtually no alkylation activity is observed with a highly-fluorinated mordenite. Example 10 illustrates benzene alkylation with 1-decene using a solid acid, fluorided clay catalyst and the process design of FIG. 1 comprising a column of solid acid catalyst, a liquid reboiler fitted with product takeoff, water collection and takeoff, and a feed inlet above the catalyst bed. Typical data in Table 8 show greater than 95% 1-decene conversion per pass, 10–17% total decylbenzene product ($\Sigma$Ph-$C_{10}$) effluent concentrations, and 37–38% 2-phenyldecane (2-Ph-$C_{10}$) selectivities.

Comparative Example 2 shows the poor alkylation performance of the LAB production unit of FIG. 2 when the $C_{10}$–$C_{14}$ paraffin dehydrogenate is injected separately from the benzene, at a point midway up the catalyst bed. In this comparative example, lower alkylate concentrations were obtained and higher concentration of heavies were observed.

Examples 11–17 illustrate benzene alkylation runs using similar technology, but where the production of total decylbenzene product, $\Sigma$Ph-$C_{10}$ is shown as a function of changes in benzene/1-decene feed rates (LHSV varied from 0.4–1.0), feed composition (benzene/1-decene molar ratio varied from 20:1 to 5:1), selected olefin (benzene/1-octene–20:1), reactor tube diameter (varied from 1"–1⅝") and catalyst life (200 hr). Example 18 shows the use of a solid acid zeolite (beta-zeolite) catalyst in the same equipment and where 2-Ph-$C_{10}$ selectivity is 50%.

Example 19 illustrates alkylation of benzene using another solid acid zeolite (dealuminized mordenite) in the same unit and using a benzene plus olefin/paraffin feed mix. Good catalyst life is realized with this mordenite using HC feed mix.

Examples 20 and 21 demonstrate benzene alkylation with 1-decene in a pressurized version of the unit, shown in FIG. 2, using either acidic fluorided clay or beta zeolite catalyst.

Examples 22–30 illustrate LAB production using the process and system of the present invention with the preferred flouride-treated mordenite catalyst. In particular, Example 23 illustrates LAB production from paraffin dehydrogenate using the fluoride-treated mordenite catalyst of example B, where good catalyst life (250+ hrs) is achieved without catalyst regeneration, while maintaining a 2-phenyl LAB selectivity of >70% and high LAB productivity without significant loss of fluoride. Comparative example 1, on the other hand, using untreated mordenite, with no fluoride added, shows a rapid decline in LAB production. In addition, examples 24 and 25 illustrate LAB production using a 5:1 molar benzene/$C_{10}$–$C_{14}$ olefin feed mix and the fluoride-treated mordenite catalysts of Example B when operating at different LHSV's in the range of 0.2–0.4 $hr^{-1}$. Example 25 shows 2-phenyl LAB selectivity of >70% coupled with high LAB productivity over a time period greater than 400 hours. Example 24 shows that catalyst life may exceed 500 hours without catalyst regeneration. Example 26 illustrates LAB production with the fluoride-treated mordenite catalyst where the alkylation is conducted at higher temperatures and under pressure. Examples 27–29 illustrate the performance of three HF-treated mordenite catalysts with different fluoride loadings. Example 30 shows how virtually no alkylation activity is observed with a highly-fluorinated mordenite.

Examples A and B illustrate the preparation of fluoride-treated mordenite catalyst.

Example A

This example illustrates the preparation of a hydrogen fluoride-modified mordenite.

To 30 g of acidified mordenite (LZM-8, $SiO_2/Al_2O_3$ ratio 17; $Na_2O$ wt % 0.02, surface area 517 $m^2/g$, powder, from Union Carbide Corp.) was added 600 ml of 0.4% hydrofluoric acid solution, at room temperature. After 5 hours the solid zeolite was removed by filtration, washed with distilled water, dried at 120° C. overnight, and calcined at 538° C.

Example B

The example illustrates the preparation of a hydrogen fluoride-modified mordenite.

To 500 g of acidified, dealuminized, mordenite (CBV-20A from PQ Corp.; $SiO_2/Al_2O_3$ molar ratio 20; $Na_2O$, 0.02 wt %; surface area 550 $m^2/g$, 1/16" diameter extrudates, that had been calcined at 538° C., overnight) was added a solution of 33 ml of 48% HF solution in 1633 ml of distilled water, the mix was cooled in ice, stirred on a rotary evaporator overnight, then filtered to recover the extruded solids. The extrudates were further washed with distilled water, dried in vacuo at 100° C., and then calcined at 538° C., overnight.

Analyses of the treated mordenite showed:

| | |
|---|---|
| F: | 1.2% |
| Acidity: | 0.49 meq/g |

Example 1

This example illustrates the preparation of linear alkylbenzenes using a hydrogen fluoride-modified mordenite catalyst.

To a 500 ml flask, fitted with condenser and Dean Stark Trap was added 100 ml of benzene (reagent grade) plus 10 g of hydrogen fluoride-modified mordenite zeolite, prepared by the method of Example A. The mix was refluxed for 15–20 minutes to remove small amounts of moisture, then a combination of benzene (50 ml) plus 1-dodecene (10 g) was injected into the flask and the solution allowed to reflux for 3 hours.

Upon cooling, the modified mordenite catalyst was removed by filtration, the filtrate liquid flashed to remove unreacted benzene, and the bottoms liquid analyzed by gas chromatography.

Typical analytical data are summarized in Table 1.

TABLE 1

| DODECENE | LAB ISOMER DISTRIBUTION (%) | | | | | HEAVIES | LINEAR LAB (LLAB) |
|---|---|---|---|---|---|---|---|
| CONV. (%) | 2-Ph | 3-Ph | 4-Ph | 5-Ph | 6-Ph | (%) | (%) |
| 99.7 | 79.9 | 16.6 | 0.8 | 1.3 | 1.3 | 0.2 | 95.9 |

Example 2

This example illustrates the preparation of linear alkylbenzenes from paraffin dehydrogenate using a hydrogen fluoride-treated mordenite catalyst.

In the example, benzene was alkylated with a sample of $C_{10}$–$C_{14}$ paraffin dehydrogenate containing about 8.5% $C_{10}$–$C_{14}$ olefins. Alkylation was conducted in a process unit as shown in FIG. 1.

Alkylation was conducted by first charging 500 ml of a benzene/paraffin dehydrogenate mix (10:1 molar ratio, benzene/$C_{10}$–$C_{14}$ olefin) to the reboiler and 250 cc of the HF-treated mordenite of example B to the 1.1" i.d. reaction zone. The mordenite was held in place using Goodloe packing. The reboiler liquid was then heated to reflux and a benzene plus $C_{10}$–$C_{14}$ paraffin dehydrogenate mix (10:1 molar ratio, benzene/$C_{10}$–$C_{14}$ olefin) continuously introduced into the unit above the catalyst column at the rate of 100 cc/hr. (LHSV–0.4 $hr^{-1}$).

Under steady state, reflux, conditions liquid product was continuously withdrawn from the reboiler and water continuously taken off from the water trap. The crude liquid product was periodically analyzed by gas chromatography. The reboiler temperature was typically in the controlled range of 97–122° C. The column head temperature variability was 78–83° C. A summary of the analytical results may be found in Table 2.

After 253 hours on stream, the recovered HF-treated mordenite catalyst showed by analysis:

| | |
|---|---|
| F: | 1.1% |
| Acidity: | 0.29 meq/g |
| $H_2O$: | 0.3% |

TABLE 2

| Time on Stream (Hrs) | Sample | Alkylate Conc. (%) | 2-Phenyl Sel. (%) | $C_6H_6$ Conc. (%) |
|---|---|---|---|---|
| 0 | 0 | 1.4 | | 32.3 |
| 2 | 1 | 3.4 | | 19.7 |
| 4 | 2 | 5.8 | 74.9 | 16.6 |
| 6 | 3 | 6.6 | 75.8 | 25.2 |
| 32 | 4 | 7.9 | 80.7 | 27.0 |
| 56 | 5 | 7.8 | 82.7 | 27.0 |
| 69 | 6 | 7.3 | 81.4 | 27.4 |
| 94 | 7 | 6.5 | 82.0 | 27.8 |
| 118 | 8 | 6.0 | 78.4 | 27.7 |
| 142 | 9 | 5.9 | 81.3 | 26.9 |
| 166 | 10 | 5.4 | 81.5 | 27.3 |
| 207 | 11 | 5.3 | 81.3 | 26.1 |
| 229 | 12 | 5.1 | 81.1 | 27.4 |
| 253 | 13 | 4.9 | 81.4 | 28.1 |

Comparative Example 1

This example illustrates the preparation of linear alkylbenzenes from paraffin dehydrogenate using an untreated mordenite catalyst.

Following the procedures of Example 9, the alkylation unit was charged with 250 cc of untreated, calcined, mordenite, (the starting mordenite of Example B), and the liquid feed comprised benzene plus $C_{10}$–$C_{14}$ paraffin dehydrogenate mix in a 10: 1 molar ratio of benzene/$C_{10}$–$C_{14}$ olefin.

Typical results are summarized in Table 3.

The recovered mordenite showed by analysis:

| | |
|---|---|
| Acidity: | 0.29 meq/g |
| $H_2O$: | 2.1% |

TABLE 3

| Time on Stream (Hrs) | Sample | Alkylate Conc. (%) | 2-Phenyl Sel. (%) | $C_6H_6$ Conc. (%) |
|---|---|---|---|---|
| 0 | 0 | | | 11.2 |
| 2 | 1 | 6.50 | | 9.9 |
| 4 | 2 | 7.16 | 73.2 | 17.1 |
| 6 | 3 | 7.09 | 73.1 | 26.4 |
| 22 | 4 | 8.61 | 73.9 | 26.6 |
| 31 | 5 | 10.49 | 67.4 | 15.8 |
| 46 | 6 | 7.39 | 75.0 | 27.7 |
| 70 | 7 | 6.39 | 75.1 | 28.5 |
| 93 | 8 | 6.08 | 73.6 | 23.0 |
| 144 | 9 | 5.21 | 73.6 | 15.8 |
| 157 | 10 | 4.40 | 73.9 | 26.2 |

TABLE 3-continued

| Time on Stream (Hrs) | Sample | Alkylate Conc. (%) | 2-Phenyl Sel. (%) | $C_6H_6$ Conc. (%) |
|---|---|---|---|---|
| 180 | 11 | 3.06 | 69.6 | 27.1 |
| 204 | 12 | 1.32 | | 19.5 |
| 228 | 13 | 1.32 | | 33.3 |

Example 3

This example also illustrates the preparation of linear alkylbenzenes from paraffin dehydrogenate using a hydrogen fluoride-treated mordenite catalyst.

Following the procedures of Example 2, the alkylation unit was charged with 250 cc of the HF-treated mordenite of Example B, and the liquid feed comprised a benzene plus $C_{10}$–$C_{14}$ paraffin dehydrogenate mix in a 5:1 molar ratio of benzene/$C_{10}$–$C_{14}$ olefin, the reboiler temperature was typically in the range of 122–188° C., the column head temperature 78–83° C. Typical analytical results are summarized in Table 4.

After 503 hours on stream, the recovered HF-treated mordenite catalyst showed on analysis:

| | |
|---|---|
| F: | 1.0% |
| Acidity: | 0.35 meq/g |
| $H_2O$: | 0.1% |

TABLE 4

| Time on Stream (Hrs) | Sample | Alkylate Conc. (%) | 2-Phenyl Sel. (%) | $C_6H_6$ Conc. (%) | Corrected[a] Alkylate Conc. (%) |
|---|---|---|---|---|---|
| 0 | 0 | 1.0 | | 8.9 | 1.1 |
| 2 | 1 | 3.5 | 61.8 | 0.3 | 3.5 |
| 4 | 2 | 7.1 | 72.1 | 0 | 7.1 |
| 6 | 3 | 6.8 | 76.7 | 7.2 | 7.3 |
| 34 | 4 | 8.4 | 79.7 | 14.3 | 9.8 |
| 71 | 5 | 7.2 | 81.8 | 14.6 | 8.5 |
| 96 | 6 | 6.5 | 80.8 | 15.5 | 7.7 |
| 119 | 7 | 6.3 | 80.6 | 15.1 | 7.4 |
| 643 | 8 | 6.0 | 81.0 | 14.3 | 7.0 |
| 168 | 9 | 5.9 | 80.7 | 14.4 | 6.9 |
| 239 | 10 | 5.0 | 78.2 | 8.8 | 5.5 |
| 263 | 11 | 5.3 | 79.2 | 13.5 | 6.2 |
| 288 | 12 | 5.0 | 79.6 | 16.5 | 6.0 |
| 311 | 13 | 5.4 | 79.4 | 4.1 | 5.6 |
| 335 | 14 | 5.5 | 79.2 | 8.2 | 6.0 |
| 408 | 15 | 4.9 | 79.4 | 13.1 | 5.6 |
| 432 | 16 | 4.7 | 78.8 | 14.4 | 5.5 |
| 456 | 17 | 4.4 | 78.5 | 14.1 | 5.1 |
| 479 | 18[a] | 4.7 | 78.6 | 2.7[b] | 4.8 |
| 488 | 19[b] | 4.9 | 78.5 | 2.4[c] | 5.0 |
| 503 | 20[b] | 5.1 | 78.9 | 0.6[c] | 5.1 |

[a]Corrected for benzene in effluent sample.
[b]Applied pressure 8" $H_2O$
[c]Applied pressure 12" $H_2O$ Example 4

This example also illustrates the preparation of linear alkylbenzenes from paraffin dehydrogenate using a hydrogen fluoride-treated mordenite catalyst.

Following the procedures of Example 2, alkylation was conducted in the glassware unit of FIG. 1 complete with catalyst column, reboiler, condenser and controls. To the reaction zone was charged 500 cc of HF-treated mordenite of Example B. The liquid feed comprised a benzene plus $C_{10}$–$C_{14}$ paraffin dehydrogenate mix in a 5:1 molar ratio of benzene/$C_{10}$–$C_{14}$ olefin. The feed rate was 100 cc/hr (LHSV:0.2 $hr^{-1}$).

Under typical steady state, reflux, conditions, with a reboiler temperature range of 131–205° C. and a head temperature of 76–83° C., typical results are summarized in Table 5.

TABLE 5

| Pressure (Inch $H_2O$) | Reboiler Temp. (° C.) | Time on Stream (Hrs) | Sample | Alkylate Conc. (%) | 2-Phenyl Sel. (%) | $C_6H_6$ Conc. (%) | Corrected[a] Alkylate Conc. (%) |
|---|---|---|---|---|---|---|---|
| | | Benzene/$C_{10}$–$C_{14}$ Olefin/Paraffin Feed) | | | | | |
| 12 | 205 | 2 | 1 | 8.2 | 74.3 | 0.5 | 8.3 |
| | 193 | 4 | 2 | 9.2 | 75.0 | 0.4 | 9.2 |
| | 175 | 6 | 3 | 10.0 | 74.8 | 2.3 | 10.3 |
| | 204 | 21 | 4 | 12.7 | 78.7 | 0.3 | 12.7 |
| | 146 | 44 | 5 | 11.7 | 81.0 | 10.4 | 12.9 |
| | 136 | 68 | 6 | 11.5 | 81.8 | 10.0 | 12.7 |
| | | 2–3 days | C[b] | 11.6 | 81.4 | 9.4 | 12.7 |
| | 136 | 93 | 7 | 11.3 | 82.6 | 10.8 | 12.5 |
| | | 4–5 days | C-1[b] | 11.0 | 81.8 | 11.0 | 12.2 |
| | 142 | 165 | 8 | 10.4 | 83.0 | 11.4 | 11.5 |
| | 142 | 189 | 9 | 10.2 | 83.4 | 10.5 | 11.2 |
| | 146 | 213 | 10 | 9.7 | 80.2 | 11.2 | 10.7 |
| | 139 | 238 | 11 | 9.6 | 83.4 | 11.1 | 10.7 |
| | 143 | 261 | 12 | 9.9 | 81.9 | 11.0 | 11.0 |
| | 133 | 333 | 13 | 9.2 | 83.4 | 11.3 | 10.3 |
| | 138 | 356 | 14 | 8.9 | 83.5 | 11.1 | 9.9 |
| | 138 | 381 | 15 | 8.8 | 83.0 | 11.3 | 9.8 |
| | 131 | 405 | 16 | 8.7 | 82.8 | 11.2 | 9.7 |

[a]Corrected for benzene in effluent sample
[b]Composite product

Example 5

This example illustrates the preparation of linear alkylbenzenes from paraffin dehydrogenate using a hydrogen fluoride-treated mordenite catalyst.

Following the procedures of Example 2, alkylation of benzene with $C_{10}$–$C_{14}$ paraffin dehydrogenate was conducted using the stainless-steel unit of FIG. 2, complete with catalyst column, reboiler, condenser, and controls. About 250 cc or HF-treated mordenite of Example B was charged to the column. The liquid feed comprised benzene plus $C_{10}$–$C_{14}$ paraffin dehydrogenate mix in a 10:1 molar ratio of benzene/$C_{10}$–$C_{14}$ olefin. The LHSV varied from 0.2 to 0.4 $hr^{-1}$.

Alkylation was conducted over a range of column and reboiler temperatures and a range of exit pressures. Typical results are summarized in Table 6.

TABLE 6

| Column Temp (□C) | Pressure DIFF (psi) | Pressure EXIT (psi) | Pot Temp. (□C) | Time (hr) | Sample (#) | Alkylate Conc. (%) | 2-Phenyl Sel. (%) | $C_6H_6$ Conc. (%) |
|---|---|---|---|---|---|---|---|---|
| 149-129 | 0.1 | 0 | 188 | 4 | 1 | 3.8 | | 6.3 |
| 152-126 | 0 | 0 | 200 | 20 | 2 | 1.8 | | 32.7 |
| 195-108 | 0 | 0 | 199 | 25 | 3 | 5.7 | | 8.7 |
| 218-111 | 0 | 0 | 201 | 28 | 4 | 0.8 | | 67.5 |
| 212-118 | 0 | 0 | 201 | 44 | 5 | 8.8 | 71.7 | 4.5 |
| 209-114 | 0.2 | 0 | 198 | 52 | 6 | 2.4 | | 47.3 |
| 228-116 | 0 | 0 | 197 | 68 | 7 | 6.9 | 72.6 | 12.4 |
| 187-107 | 0.5 | 0 | 197 | 76 | 8 | 2.9 | 74.6 | 44.1 |
| | | | | 76 | 9[a] | 4.8 | 72.9 | 25.3 |
| | | | | | 9C[b] | 6.8 | 72.2 | 1.0 |
| 174-107 | 0 | 0 | 178 | 6 | 10 | 4.1 | 79.2 | 54.9 |
| 170-106 | 0 | 0 | 172 | 22 | 11 | 2.0 | | 59.8 |
| | | | | 28 | 12[a] | 6.6 | 76.8 | 26.8 |
| 142-107 | 0 | 0 | 136 | 31 | 13 | 4.8 | 67.9 | 18.9 |
| 141-110 | 0 | 0 | 138 | 47 | 14 | 4.4 | 65.9 | 16.9 |
| 142-110 | 0 | 0 | 136 | 55 | 15 | 5.0 | 63.9 | 16.6 |
| 168-111 | 0 | 0 | 131 | 71 | 16 | 4.1 | 64.8 | 16.7 |
| 170-108 | 0 | 0 | 150 | 79 | 17 | 5.0 | 72.0 | 8.8 |
| 175-113 | 0 | 0 | 143 | 95 | 18 | 5.9 | 68.1 | 15.2 |
| 145-106 | 0 | 5.2 | 188 | 14 | 19 | 3.2 | 60.2 | 9.0 |
| 149-108 | 0 | 4.2 | 186 | 20 | 20 | 4.8 | 66.3 | 12.0 |
| 160-118 | 0 | 11.7 | 213 | 29 | 21 | 4.2 | | 6.7 |
| 160-119 | 0 | 9.3 | 210 | 44 | 22 | 5.2 | | 6.6 |

[a]Composite product
[b]Stripped composite product

Examples 6–8

These examples illustrate the preparation of linear alkylbenzenes using hydrogen fluoride-modified mordenite catalysts with different fluoride treatment levels.

Following the procedures of Example 1, the alkylation unit was charged with benzene (100 ml), a 10 g sample of hydrogen fluoride-modified mordenite prepared by the procedure of Example B, plus a mix of benzene (50 ml) and 1-decene (10 g). Three HF-treated mordenites were tested, having the composition:

| | |
|---|---|
| Catalyst "C" | 0.25% HF on mordenite (CBV-20A) |
| Catalyst "D" | 0.50% HF on mordenite (CBV-20A) |
| Catalyst "E" | 1.0% HF on mordenite (CBV-20A) |

In each experiment samples of the bottoms liquid fraction were withdrawn at regular periods and subject to gas chromatography analyses. The results are summarized in Table 7.

TABLE 7

| CATALYST | TIME | % LLAB | % ISOS | % HVY | % 2Ph | % 3Ph | % 4Ph | % 5Ph | % 6&7Ph |
|---|---|---|---|---|---|---|---|---|---|
| D (0.5% HF) | 10 | 11.75 | 0.14 | 0 | 73.36 | 21.87 | 2.89 | 0.94 | 1.02 |
| | 20 | 12.43 | 0.21 | 0 | 72.97 | 21.96 | 3.14 | 1.13 | 0.81 |
| | 30 | 12.88 | 0.21 | 0 | 72.67 | 22.13 | 3.03 | 1.16 | 1.01 |
| | 40 | 12.27 | 0.22 | 0 | 73.02 | 21.92 | 2.85 | 1.06 | 1.14 |
| | 50 | 12.15 | 0.98 | 0 | 72.46 | 21.67 | 3.21 | 1.17 | 1.49 |
| | 50 | 12.24 | 1.01 | 0 | 72.53 | 21.63 | 3.23 | 1.12 | 1.44 |
| | 60 | 12.28 | 0.21 | 0 | 72.96 | 22.07 | 2.93 | 1.14 | 0.91 |
| | 60 | 11.98 | 0.21 | 0 | 72.97 | 22.21 | 2.93 | 1.17 | 0.83 |
| C (0.25% HF) | 10 | 12.2 | 0.18 | 0 | 72.54 | 22.46 | 3.21 | 0.98 | 0.82 |
| | 20 | 12.7 | 0.39 | 0 | 71.51 | 22.61 | 2.91 | 1.02 | 2.13 |
| | 30 | 12.52 | 0.21 | 0 | 71.96 | 22.68 | 2.96 | 1.04 | 1.36 |
| | 40 | 12.75 | 0.21 | 0 | 71.84 | 22.67 | 3.22 | 1.02 | 1.25 |
| | 50 | 12.98 | 0.21 | 0 | 71.57 | 22.81 | 3.16 | 1.08 | 1.39 |
| | 60 | 12.54 | 0.21 | 0 | 71.45 | 22.81 | 3.19 | 1.12 | 1.44 |
| | 60 | 12.33 | 0.21 | 0 | 71.61 | 22.87 | 2.92 | 1.05 | 1.31 |
| E (1.0% HF) | 10 | 10.56 | 0.05 | 0 | 75.19 | 19.41 | 2.18 | 3.22 | |
| | 20 | 12.95 | 0.15 | 0 | 74.36 | 19.23 | 3.01 | 3.4 | |
| | 30 | 13.44 | 0.18 | 0 | 74.11 | 19.42 | 3.2 | 3.27 | |
| | 40 | 13.16 | 0.15 | 0 | 074.16 | 19.38 | 3.12 | 3.34 | |
| | 50 | 13.1 | 0.15 | 0 | 74.43 | 19.16 | 3.21 | 3.28 | |
| | 60 | 12.83 | 0.15 | 0 | 74.28 | 19.49 | 2.88 | 3.35 | |
| | 60 | 12.87 | 0.16 | 0 | 73.82 | 19.97 | 2.8 | 3.2 | |

Example 9

This example illustrates the inactivity of a heavily loaded hydrogen-fluoride modified mordenite catalyst.

Following the procedures of Example 2, the alkylation unit was charged with 100 cc of a hydrogen fluoride-treated mordenite (CBV-20A) prepared by the method of Example B but having a much higher loading of HF (fluoride content 4.8%). The acidity of said HF-treated mordenite was 0.15 meq/g. No significant amount of alkylated product was detected by gas chromatography.

Example 10

This example illustrates an improved, continuous benzene alkylation using a solid acid, fluorided clay catalyst and the process design of FIG. 1. Benzene alkylation with 1-decene was conducted using the process unit design of FIG. 1, attached. The process unit comprises the following principal features: a column of solid acid catalyst, packing columns above and below the catalyst bed, a liquid reboiler fitted with a liquid bottoms product takeoff, a condenser fitted with water collection and takeoff, a feed inlet above the catalyst column and the necessary temperature and pressure controls. In this example, alkylation was conducted by first charging 100 ml of benzene/1-decene (20:1 molar) mix to the reboiler and 250 cc of solid acid clay catalyst (0.5% HF on acidic montmorillonite clay granules dried in vacuum, 20/60 mesh) to the 1" diameter reaction zone. The solid acid catalyst was held in place using Goodloe packing. The reboiler mixture was then heated to reflux and a benzene/1-decene mixture (20:1 molar) was continuously introduced into the unit above the catalyst column at the rate of 20 cc/hr (LHSV–0.08). Under steady state conditions, liquid product was continuously withdrawn from the reboiler and water taken off from the water trap. The crude liquid product was periodically analyzed by gas-liquid chromatography (hereinafter "GLC"). Results are summarized in Table 8.

TABLE 8

Example 10 Results (Benzene/1-Decene Feed)

| Time On-stream (hrs) | Sample | ΣPh-$C_{10}$ Concentration (%) | 2-Ph-$C_{10}$ Selectivity (%) | Σ$C_{10}$ |
|---|---|---|---|---|
| | 0[a] | 10.4 | 38 | 0.4 |
| 2 | 1 | 12.4 | 38 | 0.3 |
| 4 | 2 | 14.0 | 37 | 0.4 |
| 6 | 3 | 17.2 | 38 | 0.3 |
| 8 | 4 | 15.3 | 38 | 0.3 |
| 14 | 5[b] | 11.9 | 38 | 0.1 |
| 21 | 6[b] | 12.8 | 38 | 0.1 |

[a]Benzene/1-decene (20:1) in reboiler brought to reflux
[b]Shut down overnight

Examples 11–17

These examples illustrate continuous benzene alkylation using the same solid acid clay catalyst of Example 10 and the process design of FIG. 1, but with a variety of process modifications. Following the procedures of Example 10 and using the equipment of FIG. 1, alkylation of benzene was conducted as described in Example 10 but with the following modifications: Example 11, The benzene/1-decene feed rate was increased to 100 cc/hr (LHSV 0.4)—see Table 9; Example 12, The reaction zone inner diameter was increased to 1⅝" (4.1 cm)—see Table 10; Example 13, The benzene/1-decene feed rate was further increased to LHSV 1.0—see Table 11. Example 14, The benzene/1-decene feed molar ratio was lowered to 10:1—see Table 12; Example 15, The benzene/1-decene feed molar ratio was further lowered to 5:1—see Table 13; Example 16, 200 hr of solid acid clay catalyst life without significant loss of activity was demonstrated—see Table 14; and Example 17, Benzene alkylation with 1-octene was demonstrated—see Table 15.

TABLE 9

Example 11 Results (Benzene/1-Decene Feed)

| On-stream Time (hrs) | Sample | ΣPh-$C_{10}$ Concentration (%) | 2-Ph-$C_{10}$ Selectivity (%) | Σ$C_{10}$ | Weight (g) |
|---|---|---|---|---|---|
| | 0[a] | 23.5 | 39 | 0.1 | |
| 2 | 1 | 9.6 | 38 | <0.1 | |
| 4 | 2 | 11.5 | 38 | <0.1 | |
| 6 | 3 | 11.3 | 38 | <0.1 | |
| 13 | 4[b] | 12.2 | 38 | <0.1 | |
| 20 | 5[b] | 12.7 | 37 | <0.1 | |
| 28 | 6[b] | 9.4 | 36 | <0.1 | |
| 36[f] | 7[b] | 9.9 | 36 | <0.1 | |
| | Effluent-1[c] | 92.3 | 36 | 0.1 | 203 |
| | Effluent-2[c] | | | | 212 |

[a]Reboiler liquid: product from run Example 1
[b]Shut down overnight
[c]Stripped product Example 11 Remarks 250 cc of the catalyst from Example 1 was used: acidity–0.45 meq/g; $H_2O$–0.73%
LHSV–0.4
Characteristics of recovered catalyst: acidity–0.47 meq/g; $H_2O$–2.0%

TABLE 10

Example 12 Results (Benzene/1-Decene Feed)

| Time On-stream (hrs) | Sample | ΣPh-$C_{10}$ Concentration (%) | 2-Ph-$C_{10}$ Selectivity (%) | Σ$C_{10}$ | Weight (g) |
|---|---|---|---|---|---|
| | 0[a] | 11.3 | 36 | <0.1 | |
| 2 | 1 | 13.7 | 37 | <0.1 | |
| 4 | 2 | 11.3 | 37 | <0.1 | |
| 6 | 3 | 10.8 | 37 | <0.1 | |
| 14 | 4[b] | 11.2 | 36 | <0.1 | |
| 21 | 5[b] | 8.4 | 35 | <0.1 | |
| 29 | 6[b] | 9.7 | 36 | <0.1 | |
| 37 | 7[b] | 9.1 | 35 | <0.1 | |
| | Effluent[c] | 94.6 | 35 | 0.1 | 216 |

[a]Reboiler liquid: product from Example 2
[b]Shut down overnight
[c]Stripped product Example 12 Remarks 250 cc of the catalyst from Example 1 was set in a 1⅝" (4.1 cm) diameter column
LHSV–0.4
Characteristics of recovered catalyst: acidity–0.44 meq/g; $H_2O$–4.9%

TABLE 11

Example 13 Results (Benzene/1-Decene Feed)

| Time On-stream (hrs) | Sample | ΣPh-$C_{10}$ Concentration (%) | 2-Ph-$C_{10}$ Selectivity (%) | Σ$C_{10}$ | Weight (g) |
|---|---|---|---|---|---|
| | 0[a] | 8.4 | 36 | <0.1 | |
| 2 | 1 | 24.5 | 37 | 3.8 | |
| 5 | 2 | 8.8 | 37 | 5.0 | |
| 6 | 3 | 2.4 | 38 | 2.4 | |
| 14[b] | 4 | 2.8 | 39 | 3.1 | |
| 22[b] | 5 | 2.5 | 40 | 3.0 | |
| 30[b] | 6 | 2.1 | 43 | 3.2 | |
| | Effluent[c] | 91.4 | 40 | | 99 |

[a]Reboiler liquid: product from run 7102-30
[b]Shut down overnight
[c]Stripped product Example 13 Remarks 200 cc of the catalyst from Example 1 was set in a 1⅝" (4.1 cm) diameter column
LHSV–1.0
Characteristics of the recovered catalyst: acidity–0.46 meq/g; $H_2O$–3.8%

TABLE 12

Example 14 Results (Benzene/1-Decene Feed)

| Time On-stream (hrs) | Sample | ΣPh-$C_{10}$ Concentration (%) | 2-Ph-$C_{10}$ Selectivity (%) | Σ$C_{10}$ | Weight (g) |
|---|---|---|---|---|---|
| | 0 | 0.2 | | 16.3 | |
| 2 | 1 | 5.5 | 35 | 13.1 | |
| 4 | 2 | 12.6 | 37 | 8.7 | |
| 6 | 3 | 15.1 | 37 | 4.7 | |
| 13[a] | 4 | 16.3 | 36 | 0.8 | |
| 21[a] | 5 | 16.9 | 35 | 0.2 | |
| 29[a] | 6 | 17.4 | 35 | 0.1 | |
| | Effluent[b] | 91.9 | 36 | 0.7 | 318 |

[a]Shut down overnight
[b]Stripped product

Example 14 Remarks 250 cc of the catalyst from Example 1 was set in a 1⅝" (4.1 cm) diameter column
LHSV–0.4

TABLE 13

Example 15 Results (Benzene/1-Decene Feed)

| Time On-stream (hrs) | Sample | ΣPh-$C_{10}$ Concentration (%) | 2-Ph-$C_{10}$ Selectivity (%) | Σ$C_{10}$ | Weight (g) |
|---|---|---|---|---|---|
| | 0 | 1.3 | | 21.9 | |
| 2 | 1 | 7.5 | 36 | 22.7 | |
| 4 | 2 | 18.8 | 36 | 13.5 | |
| 6 | 3 | 24.2 | 36 | 8.3 | |
| 28 | 4 | 31.6 | 35 | 0.6 | |
| 46 | 5 | 21.7 | 36 | 5.8 | |
| 70[a] | 6 | 17.4 | 38 | 6.0 | |
| | Effluent[b] | 89.3 | 35 | 0.7 | 504 |
| 79 | 7B | 20.8 | 39 | 7.8 | |
| 87 | 8 | 16.8 | 40 | 8.9 | |
| 110 | 9 | 16.1 | 39 | 7.8 | |
| 135 | 10 | 15.6 | 40 | 9.1 | |

TABLE 13-continued

Example 15 Results (Benzene/1-Decene Feed)

| Time On-stream (hrs) | Sample | ΣPh-$C_{10}$ Concentration (%) | 2-Ph-$C_{10}$ Selectivity (%) | Σ$C_{10}$ | Weight (g) |
|---|---|---|---|---|---|
| 159 | 11 | 15.2 | 39 | 8.5 | |
| | Effluent[b] | 86.3 | 40 | 0.5 | 284 |

[a]Shut down over weekend
[b]Stripped product

Example 15 Remarks 250 cc of the catalyst from Example 1 was set in a 1⅝" (4.1 cm) diameter column
LHSV–0.4

TABLE 14

Example 16 Results (Benzene/1-Decene Feed)

| Time On-stream (hrs) | Sample | ΣPh-$C_{10}$ Concentration (%) | 2-Ph-$C_{10}$ Selectivity (%) | Σ$C_{10}$ | Weight (g) |
|---|---|---|---|---|---|
| | 0 | 1.3 | | 4.8 | |
| 2 | 1 | 8.4 | 37 | 6.9 | |
| 4 | 2 | 11.6 | 38 | 5.4 | |
| 6 | 3 | 11.6 | 37 | 2.8 | |
| 23 | 4 | 8.7 | 36 | 0.1 | |
| 46 | 5 | 11.7 | 37 | <0.1 | |
| 61 | 6 | 16.2 | 37 | <0.1 | |
| 95 | 7 | 15.9 | 36 | <0.1 | |
| 109 | 8 | 14.7 | 36 | 0.1 | |
| 133 | 9 | 14.4 | 35 | 0.2 | |
| 157 | 10 | 17.6 | 35 | 0.2 | |
| 165 | 11 | 16.3 | 35 | 0.2 | |
| 177 | 12 | 16.2 | 36 | 0.5 | |
| 201 | 13 | 14.0 | 37 | 0.7 | |
| | Effluent[a] | 93.9 | 36 | 0.2 | 209 |

[a]Stripped product

Example 16 Remarks 250 cc of the catalyst from Example 1 was set in a 1⅝" (4.1 cm) diameter column
LHSV–0.4

TABLE 15

Example 17 Results (Benzene/1-Octene Feed)

| Time On-stream (hrs) | Sample | ΣPh-$C_8$ Concentration (%) | 2-Ph-$C_8$ Selectivity (%) | Σ$C_8$ |
|---|---|---|---|---|
| | 0 | 7.9 | 40 | 1.5 |
| 2 | 1 | 8.9 | 40 | 1.1 |
| 4 | 2 | 11.6 | 40 | 1.1 |
| 5 | 3 | 9.2 | 40 | 0.9 |
| 23 | 4 | 9.9 | 40 | 0.2 |
| 44 | 5 | 9.9 | 40 | 0.2 |
| 81 | 6 | 10.2 | 40 | 0.1 |

Example 17 Remarks

Catalyst from Example 7 was used
Feed–100 cc/hour (LHSV–0.4)

Example 18

This example illustrates continuous benzene alkylation using a solid acid zeolite catalyst and the process design of FIG. 1. Following the procedures of Example 10 and using the equipment of FIG. 1, alkylation of benzene was conducted as described, but using 250 cc of solid acid zeolite catalyst (80% beta zeolite, 20% alumina binder, 1/16" (0.16 cm) diameter extrudates). A benzene/1-decene mixture (20:1 molar) was fed continuously at a rate of 100 cc/hr. Under steady state conditions, product effluent samples exhibited the following characteristics: ΣPh-$C_{10}$ concentration, 9.7%; 2-Ph-$C_{10}$ selectivity, 50%; and Σ$C_{10}$ concentration, 0.1%.

Example 19

This example illustrates continuous benzene alkylation with a $C_{10}$–$C_{14}$ olefin/paraffin mixture using a solid acid zeolite catalyst and the process design of FIG. 1. Following the procedures of Example 10 and using the equipment of FIG. 1, alkylation of benzene with a $C_{10}$–$C_{14}$ olefin/paraffin mixture was conducted as described in Example 10, but using 250 cc of another solid acid zeolite catalyst (dealuminized mordenite, $SiO_2/Al_2O_3$ (molar ratio 20:1), 1/16" diameter extrudates calcined at 538° C. and dried at 150° C.). A mixture of benzene and a $C_{10}$–$C_{14}$ olefin/paraffin mix (containing 8.5% olefin) was fed continuously at 100 cc/hr (LHSV–0.4). The benzene/olefin molar ratio was 10:1. Under steady state conditions, the product effluent was sampled and analyzed by GLC over approximately 100 hours of operation. The results are summarized in Table 16.

TABLE 16

Example 19 Results (Benzene/$C_{10}$–$C_{14}$ Olefin/Paraffin Feed)

| Time (hrs) On-stream | Sample | Alkylate Conc. (%) | $C_6H_6$ Conc. (%) |
|---|---|---|---|
| | 0 | — | 8.9 |
| 2 | 1 | 2.60 | 16.7 |
| 4 | 2 | 4.43 | 20.6 |
| 6 | 3 | 5.68 | 23.2 |
| 8 | 4 | 6.26 | 24.4 |
| 14 | 5 | 6.95 | 26.2 |
| 23 | 6 | 6.45 | 27.7 |
| 28 | 7 | 6.33 | 27.4 |
| 31 | 8 | 6.42 | 25.7 |
| 53 | 9 | 6.56 | 27.6 |
| 62 | 10 | 6.21 | 27.2 |
| 74 | 11 | 6.18 | 25.8 |
| 97 | 12 | 5.57 | 27.6 |

Example 20

This example illustrates continuous benzene alkylation using a solid acid fluorided clay catalyst and a pressure unit design of the type shown in FIG. 2.

Benzene alkylation with 1-decene was conducted using a process unit of the type shown in FIG. 2 constructed of 316 stainless steel. About 100 ml of benzene/1-decene (20:1) molar mix was charged to the reboiler and 250 cc of solid acid catalyst (0.5% HF on acidic montmorillonite clay granules, 20/60 mesh) was charged to the 1¼" (3.2 cm) id reaction zone. The reboiler liquid was the heated to reflux and a benzene/1-decene mixture (20:1 molar) continuously introduced into the unit above the catalyst column at a rate of 100 cc/hr. Under steady state conditions, reaction conditions were maintained as follows: Reboiler temperature, 132° C.; Reaction zone temperature range, 70–100° C.; and exit pressure, 4.1 psi. Liquid product was continuously withdrawn from the reboiler and water taken from the water trap. The crude liquid product was periodically analyzed by GLC. Typical results were as follows: ΣPh-$C_{10}$ concentration, 15.1%; 2-Ph-$C_{10}$ selectivity, 37%; and Σ$C_{10}$ concentration, <0.1%.

Example 21

This example illustrates continuous benzene alkylation using a solid acid zeolite catalyst and a pressure unit design of the type shown in FIG. 2.

Benzene alkylation with 1-decene was conducted using a process unit of the type shown in FIG. 2. Following the procedure of Example 20, 250 cc of solid acid zeolite catalyst (80% $-zeolite, $SiO_2/Al_2O_3$ (molar ratio 23.9:1), 20% alumina binder, 1/16" (0.16 cm) diameter extrudates) was charged to the 1¼" (3.2 cm) diameter reaction zone. The reboiler liquid was then heated to reflux and a benzene/1-decene mixture (20:1 molar) continuously introduced into the unit above the catalyst column at a rate of 100 cc/hr. Under steady state conditions, reaction conditions were maintained as follows: Reboiler temperature, 171° C.; Reaction zone temperature range, 100–192° C.; Exit pressure, 1.7 psi. Liquid product was continuously withdrawn from the reboiler and water taken from the water trap. The crude liquid product was periodically analyzed by GLC. Typical results were as follows: $\Sigma$Ph-$C_{10}$ concentration, 8.4%; 2-Ph-$C_{10}$ selectivity, 47%, and $\Sigma C_{10}$ concentration, 1.8%.

Example 22

This example illustrates the preparation of linear alkyl benzene from paraffin dehydrogenate using a hydrogen fluoride-treated mordenite catalyst. In the example, benzene was alkylated with a sample of $C_{10}$–$C_{14}$ paraffin dehydrogenate containing about 8.5% $C_{10}$–$C_{14}$ olefins. Alkylation was conducted in a process unit as shown in FIG. 1.

Alkylation was conducted by first charging 500 ml of a benzene/paraffin dehydrogenate mix (5:1 molar ratio, benzene/$C_{10}$–$C_{14}$ olefin) to the reboiler and 500 cc of a HF-treated mordenite to the 1.1" (2.8 cm) i.d. reaction zone. The mordenite was held in place using Goodloe packing. The reboiler liquid was then heated to reflux and a benzene plus $C_{10}$–$C_{14}$ paraffin dehydrogenate mix (5:1 molar ratio, benzene/$C_{10}$–$C_{14}$ olefin) continuously introduced into the unit above the catalyst column at the rate of 100 cc/hr (LHSV–0.2 $hr^{-1}$).

Under steady state, reflux, conditions liquid product was continuously withdrawn from the reboiler and water continuously taken off from the water trap. The crude liquid product was periodically analyzed by gas chromatography. The reboiler temperature was typically in the controlled range of 131–205° C. The column head temperature variability was 76–83° C. A summary of the analytical results may be found in Table 5.

Example 23

This example illustrates the preparation of linear alkyl benzenes from paraffin dehydrogenate using a hydrogen fluoride-treated mordenite catalyst.

Following the procedures of Example 2, alkylation of benzene with $C_{10}$–$C_{14}$ paraffin dehydrogenate was conducted using the stainless-steel unit of FIG. 2, complete with an extended catalyst column, reboiler, condenser, and controls. About 750 cc of the HF-treated mordenite of Example B was charged to the column. The liquid feed comprised benzene plus $C_{10}$–$C_{14}$ paraffin dehydrogenate mix in a 10:1 molar ratio of benzene/$C_{10}$–$C_{14}$ olefin. The LHSV remained at about 0.13 $hr^{-1}$.

Alkylation was conducted over a range of column and reboiler temperatures and a range of exit pressures. Typical results are summarized in Table 17.

TABLE 17

Example 23 Results (Benezene/$C_{10}$–$C_{14}$ Olefin/Paraffin Feed)

| Column | Pressure | | Reboiler | Time | | Alkylate | | $C_6H_6$ | Corrected Alkylate |
|---|---|---|---|---|---|---|---|---|---|
| Temp (OC) | DIFF (psi) | EXIT (psi) | Temp. (OC) | in Days | Sample (#) | Conc. (%) | 2-Phenyl Sel. (%) | Conc. (%) | Conc. (%)[a] |
| 79-47 | 0 | 4.9 | 100 | 1 | 15 | 2.5 | 61.3 | 14.3 | 2.9 |
| 77-53 | 0 | 4.1 | 100 | 2 | 16 | 2.6 | 64.4 | 17.3 | 3.1 |
| | | | | | 16[b] | 2.8 | 67.0 | 16.8 | 3.2 |
| 105-58 | 0 | 6.2 | 130 | 3 | 17 | 5.1 | 72.3 | 16.3 | 6.0 |
| 105-64 | 0 | 7.9 | 137 | 4 | 18 | 6.0 | 67.5 | 14.0 | 6.8 |
| 99-78 | 0 | 5.9 | 130 | 5 | 19 | 5.7 | 70.1 | 16.0 | 6.7 |
| 115-90 | 0.2 | 5.7 | 130 | 6 | 20 | 5.5 | 70.1 | 16.1 | 6.4 |
| 136-92 | 0.1 | 4.6 | 130 | 7 | 21 | 6.4 | 69.3 | 16.0 | 7.4 |
| 130-92 | 0 | 6.0 | 130 | 8 | 22 | 5.9 | 67.0 | 15.7 | 6.9 |
| 136-96 | 0 | 5.5 | 150 | 8 | 23 | 6.8 | 69.1 | 15.6 | 7.8 |
| 137-96 | 0.1 | 5.1 | 150 | 8 | 24 | 6.9 | 67.2 | 14.7 | 7.9 |
| 136-96 | 0 | 5.1 | 150 | 9 | 25 | 6.2 | 67.3 | 15.9 | 7.2 |
| 136-96 | 0.1 | 3.9 | 150 | 10 | 26 | 6.2 | 68.6 | 15.0 | 7.1 |
| 156-102 | 0 | 5.4 | 170 | 11 | 27 | 7.4 | 71.8 | 17.6 | 8.6[c] |
| 145-109 | 0.1 | 4.6 | 170 | 12 | 28 | 8.8 | 69.0 | 9.6 | 9.7[c] |
| 160-101 | 0 | 6.8 | 170 | 13 | 29 | 8.2 | 62.9 | 13.0 | 9.3[c] |
| 155-103 | 0 | 6.0 | 170 | 13 | 30 | 8.0 | 62.0 | 13.1 | 9.0[c] |
| 162-101 | 0 | 7.9 | 170 | 14 | 31 | 7.8 | 57.9 | 10.7 | 8.6[c] |
| 160-115 | 0 | 5.2 | 190 | 14 | 32 | 6.7 | 65.5 | 12.3 | 7.9 |
| 161-107 | 0 | 6.3 | 190 | 15 | 33 | 7.4 | 56.1 | 15.3 | 8.5 |
| 168-106 | 0 | 5.1 | 190 | 15 | 34 | 7.3 | 55.3 | 13.5 | 8.3 |
| 157-115 | 0.1 | 4.6 | 190 | 16 | 35 | 6.2 | 61.1 | 27.2 | 7.9 |
| 151-105 | 0.2 | 4.8 | 210 | 17 | 36 | 9.5 | 58.9 | 3.4 | 9.5 |
| 156-105 | 0.2 | 5.4 | 210 | 18 | 37 | 6.5 | 58.6 | 3.1 | 6.9 |

[a]Corrected for $C_6H_6$ in Effluent Sample
[b]Composite Product
[c]Total Heavies Concentration (dialkylated aromatics plus tetralins) less than 0.5%

Examples 24–26

These examples illustrate the preparation of linear alkyl benzene using hydrogen fluoride-modified mordenite catalysts with different fluoride treatment levels. Following the procedures of Example 1, the alkylation unit was charged with benzene (100 ml), a 10 g sample of hydrogen fluoride-modified mordenite prepared by the procedure of Example B, plus a mix of benzene (50 ml) and 1-decene (10 g). Three HF-treated mordenites were tested, having the composition: Catalyst "C", 0.25% HF on mordenite (CBV-20A); Catalyst "D" 0.50% HF on mordenite (CBV-20A); and Catalyst "E" 1.0% HF on mordenite (CBV-20A). In each experiment, samples of the bottoms liquid fraction were withdrawn at regular periods and subject to gas chromatography analyses. The results are summarized in Table 7.

Example 27

This example illustrates the inactivity of a heavily loaded hydrogen-fluoride modified mordenite catalyst. Following procedures similar to Example 2, the alkylation unit was charged with 100 cc of a hydrogen fluoride-treated mordenite (CBV-20A) prepared by the method of Example B but having a much higher loading of HF (fluoride content 4.8%). The acidity of said HF-treated mordenite was 0.15 meq/g. No significant amount of alkylated product was detected by gas chromatography.

Comparative Example 2

This example illustrates the poor performance of the second continuous reactive distillation reactor of FIG. 2 when the $C_{10}$–$C_{14}$ paraffin dehydrogenate feed component is injected into the catalyst bed, 132, at the midpoint, 133, rather than above the catalyst column at feed inlet point 114.

Following procedures similar to Example 23, the alkylation unit was charged with 750 cc of the hydrogen fluoride-treated mordenite prepared by the method of Example B, but the liquid feed components, benzene and $C_{10}$–$C_{14}$ paraffin dehydrogenate mix, were charged separately to the alkylation unit of FIG. 2. Benzene was charged above the catalyst column at feed inlet point 114 at a rate of 28 cc/hr. The $C_{10}$–$C_{14}$ paraffin dehydrogenate was charged separately at the midpoint, 133, of the catalyst bed at a rate of 72 cc/hr. Under steady state conditions, with a reboiler temperature of 170° C. and a reaction zone temperature range of 100–142° C., GLC analysis of typical product effluent liquid yielded the following results:

| | |
|---|---|
| Σ Alkylate Concentration: | 4.9% |
| 2-Phenyl Isomer Selectivity: | 72.2% |
| Σ $C_6H_6$ Concentration: | 7.5% |
| Σ Corrected Alkylate Concentration: | 5.3% |
| Σ Heavies Concentration: | 4.0% |

Thus, from all of the foregoing, it is clear that the present invention provides various viable commercial processes for providing alkylated benzenes which are useful in the manufacture of linear alkyl benzene sulfonate detergents having a 2-phenyl isomer content that his higher than has been previously available in the marketplace.

The manufacture of alkyl benzene sulfonate surfactants from alkylated benzenes is well-known in the art. In general, sulfonation of the alkylated benzenes made from a process according to the invention can be accomplished using any of the well-known sulfonation systems, including those described in "Detergent Manufacture Including Zeolite Builders and other New Materials", Ed. Sittig., Noyes Data Corp., 1979, as well as in Vol. 56 in "Surfactant Science" series, Marcel Dekker, New York, 1996, including in particular Chapter 2 entitled "Alkylarylsulfonates: History, Manufacture, Analysis and Environmental Properties", pages 39–108 which includes 297 literature references. This work provides access to a great deal of literature describing various processes and process steps, not only sulfonation but also dehydrogenation, alkylation, alkylbenzene distillation and the like. Common sulfonation systems useful herein include sulfuric acid, chlorosulfonic acid, oleum, sulfur trioxide and the like. Sulfur trioxide/air is especially preferred. Details of sulfonation using a suitable air/sulfur trioxide mixture are provided in U.S. Pat. No. 3,427,342. Sulfonation processes are further extensively described in "Sulfonation Technology in the Detergent Industry", W. H. de Groot, Kluwer Academic Publishers, Boston, 1991. Any convenient workup steps may be used in a process.

Common practice is to neutralize the sulfonic acid produced in the sulfonation with any suitable alkali. Thus the neutralization step can be conducted using alkali selected from sodium, potassium, ammonium, magnesium and substituted ammonium alkalis and mixtures thereof. Potassium can assist solubility, magnesium can promote soft water performance and substituted ammonium can be helpful for formulating specialty variations of a surfactant made using an alkylated benzene according to a process of this invention. The invention encompasses any of these derivative forms of the alkylbenzenesulfonate surfactants as produced by a process of the invention and their use in finished formulated product compositions. Alternately, the acid form of an alkylated benzene sulfonate (i.e., the sulfonic acid itself) can be added directly to acidic cleaning products, or can be mixed with cleaning ingredients and subsequently neutralized.

Since finished formulated products which contain alkylated benzene sulfonate surfactants typically contain other materials known to those skilled in the art as being useful in finished cleaning product compositions, the present invention contemplates compositions which contain any amount between 99.50% and 0.25% of an alkylated benzene sulfonic acid or sulfonate produced according to a process of this invention in combination with any amount between 0.50% and 99.75% of other components known to be useful in formulating soaps, detergents, and the like. Typically, such other components include, without limitation, those materials selected from the group consisting of: fatty acids, alkyl sulfates, ethanolamines, amine oxides, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, ether sulfates, alkylphenol ethoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, and water soluble alkylbenzene sulfonates having 2-phenyl isomer content of about 40.00% or less.

Although the present invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims appended hereto. Although the processes used to make the products claimed herein have been described as employing olefin and paraffin feedstocks which are generally linear in molecular configuration, it is appreciated by those skilled in the art that commercial grade linear olefinic and paraffinic feedstocks typically contain incidental attendant quantities of non-linear olefins and paraffins, which may show up in an alkylbenzene produced by a process described by the present invention as a substrate which is part of a non-linear alkylbenzene, either by direct reaction, or by isomerizations which inevitably occur during processes of the general types of reactions described herein, as recognized by those skilled in the art.

What is claimed is:

1. A composition of matter comprising alkylbenzenes, which are prepared according to a process comprising:

a) contacting benzene and an olefin having about 8 to about 30 carbons in the presence of a mixed catalyst bed to form alkylbenzenes, wherein the mixed catalyst bed comprises fluorine-containing mordenite and a second, solid alkylbenzene alkylation catalyst, wherein the second alkylation catalyst has a selectivity to the 2-phenyl isomer of the alkylbenzenes less than the selectivity of the fluorine-containing mordenite; and b) wherein the mordenite has been treated by contacting the mordenite with an aqueous hydrogen fluoride solution, wherein the hydrogen fluoride in the aqueous solution has a concentration in the range from about 0.1 percent to about 1 percent by weight.

2. A process for producing an alkylbenzene sulfonic acid comprising the steps of:

a) providing a composition according to claim 1; and b) sulfonating a composition according to claim 1 to form an alkylbenzene sulfonic acid product.

3. The alkylbenzene sulfonic acid product produced by a process according to claim 2.

4. A process according to claim 2 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

5. The alkylbenzene sulfonate surfactant produced by the process of claim 4.

6. A composition useful as a detergent for cleaning laundry, dishes, hard surfaces, and other substrates that is formed from components comprising:

a) an alkylbenzene sulfonate surfactant component produced by a process according to claim 4 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

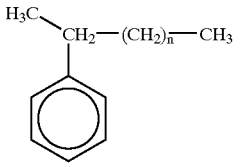

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

7. A composition of matter comprising alkylbenzenes, which are prepared according to a process comprising:

a) dehydrogenating a paraffin to form an olefin;

b) sending a feed stream of benzene and the olefin through a conduit to an alkylbenzenes alkylation reactor containing a fluorine-containing mordenite and a second alkylation catalyst, wherein the second alkylation catalyst has a selectivity to the 2-phenyl isomer of the alkylbenzenes less than the selectivity of the fluorine-containing mordenite;

c) reacting the benzene and olefin in the reactor to form a crude alkylbenzenes stream;

d) distilling the crude alkylbenzenes stream in a first distillation column to separate benzene that did not react and to form a benzene-free alkylbenzenes stream;

e) distilling the benzene-free alkylbenzenes stream in a second distillation column to separate any paraffin present and to form a paraffin-free alkylbenzenes stream;

f) distilling the paraffin-free alkylbenzene stream in a third distillation column to provide an overhead of a purified alkylbenzene stream and removing a bottoms stream containing heavies.

8. A process for producing an alkylbenzene sulfonic acid comprising the steps of:

a) providing a composition according to claim 7; and b) sulfonating a composition according to claim 7 to form an alkylbenzene sulfonic acid product.

9. The alkylbenzene sulfonic acid product produced by a process according to claim 8.

10. A process according to claim 8 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

11. The alkylbenzene sulfonate surfactant produced by the process of claim 10.

12. A composition useful as a detergent for cleaning laundry, dishes, hard surfaces, and other substrates that is formed from components comprising:

a) an alkylbenzene sulfonate surfactant component produced by a process according to claim 10 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

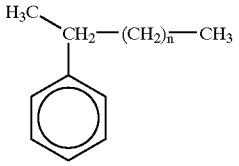

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

13. A composition of matter comprising alkylbenzenes, which are prepared according to a process comprising:

a) contacting benzene and an olefin having about 8 to about 30 carbon atoms in the presence of a fluorine-containing mordenite to form a first alkylbenzene stream;

b) contacting benzene and an olefin having about 8 to about 30 carbon atoms in the presence of an alkylation catalyst other than the fluorine-containing mordenite to form a second alkylbenzene stream;

c) combining the first alkylbenzene stream and the second alkylbenzene stream to form a third alkylbenzene stream, wherein the mordenite has been treated by contacting the mordenite with an aqueous hydrogen fluoride solution, wherein the hydrogen fluoride in the aqueous solution has a concentration in the range from about 0.1 percent to about 1 percent by weight.

14. A process for producing an alkylbenzene sulfonic acid comprising the steps of:

a) providing a composition according to claim 13; and b) sulfonating a composition according to claim 13 to form an alkylbenzene sulfonic acid product.

15. The alkylbenzene sulfonic acid product produced by a process according to claim 14.

16. A process according to claim 14 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

17. The alkylbenzene sulfonate surfactant produced by the process of claim 16.

18. A composition useful as a detergent for cleaning laundry, dishes, hard surfaces, and other substrates that is formed from components comprising:

a) an alkylbenzene sulfonate surfactant component produced by a process according to claim 16 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

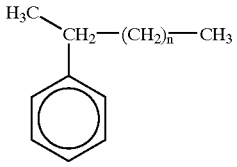

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

19. A composition of matter comprising alkylbenzenes, which are prepared according to a process comprising:

a) introducing an aromatic compound having from about 6 to about 30 carbon atoms and an olefin having from about 8 to about 30 carbon atoms above a catalyst bed containing an alkylation catalyst;

b) contacting the olefin and the aromatic compound in the presence of the alkylation catalyst under conditions such that the olefin and the aromatic compound react to form an alkylated aromatic compound;

c) allowing the alkylated aromatic compound an any unreacted aromatic compound to descend into a reboiler from the catalyst bed;

d) withdrawing the alkylated aromatic compound from the reboiler; and e) heating the contents of the reboiler such that the aromatic compound refluxes to contact the catalyst bed.

20. A process for producing an alkylbenzene sulfonic acid comprising the steps of:

a) providing a composition according to claim 19; and b) sulfonating a composition according to claim 19 to form an alkylbenzene sulfonic acid product.

21. The alkylbenzene sulfonic acid product produced by a process according to claim 20.

22. A process according to claim 20 further comprising: c) neutralizing the product of b) with a suitable alkaline substance containing one or more cations selected from the group consisting of sodium, potassium, ammonium, magnesium and substituted ammonium alkalis, thus providing an alkylbenzene sulfonate surfactant.

23. The alkylbenzene sulfonate surfactant produced by the process of claim 22.

24. A composition useful as a detergent for cleaning laundry, dishes, hard surfaces, and other substrates that is formed from components comprising:

a) an alkylbenzene sulfonate surfactant component produced by a process according to claim 22 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

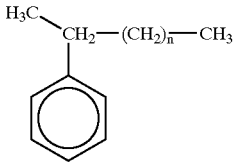

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

25. A composition of matter comprising alkylbenzenes, which are prepared according to a process comprising:

a) introducing an aromatic compound having from about 6 to about 30 carbon atoms and an olefin having from about 8 to about 30 carbon atoms above a catalyst bed containing an alkylation catalyst;

b) contacting the olefin and the aromatic compound in the presence of the alkylation catalyst under conditions such that the olefin and the aromatic compound react to form an alkylated aromatic compound;

c) allowing the alkylated aromatic compound an any unreacted aromatic compound to descend into a reboiler from the catalyst bed;

d) withdrawing the alkylated aromatic compound from the reboiler; and e) heating the contents of the reboiler such that the aromatic compound refluxes to contact the catalyst bed, wherein the process produces a selectivity to a 2-phenyl isomer in the alkylated aromatic compound of at least about 70 mole percent.

26. A process for producing an alkylated benzene sulfonic acid comprising the steps of:

a) providing a composition according to claim 25; and b) sulfonating a composition according to claim 25 to form an alkylbenzene sulfonic acid product.

27. The alkylbenzene sulfonic acid product produced by a process according to claim 26.

28. A process according to claim 26 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

29. The alkylbenzene sulfonate surfactant produced by the process of claim 28.

30. A composition useful as a detergent for cleaning laundry, dishes, hard surfaces, and other substrates that is formed from components comprising:

a) an alkylbenzene sulfonate surfactant component produced by a process according to claim 28 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

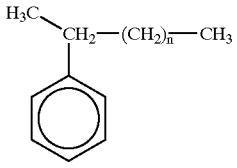

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

31. A composition of matter comprising alkylbenzenes, which are prepared according to a process comprising:

contacting benzene with an olefin of from about 8 to about 30 carbon atoms in the presence of a catalyst consisting essentially of fluorine-containing mordenite under conditions such that monoalkylated benzene is formed, wherein the mordenite has been treated by contacting mordenite with an aqueous hydrogen fluoride solution, wherein the hydrogen fluoride in the aqueous solution has a concentration in the range from about 0.1 to about 1 percent by weight.

32. A process for producing an alkylbenzene sulfonic acid comprising the steps of:

a) providing a composition according to claim 31; and b) sulfonating a composition according to claim 31 to form an alkylbenzene sulfonic acid product.

33. The alkylbenzene sulfonic acid product produced by a process according to claim 32.

34. A process according to claim 32 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

35. The alkylbenzene sulfonate surfactant produced by the process of claim 34.

36. A composition useful as a detergent for cleaning laundry, dishes, hard surfaces, and other substrates that is formed from components comprising:

a) an alkylbenzene sulfonate surfactant component produced by a process according to claim 34 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

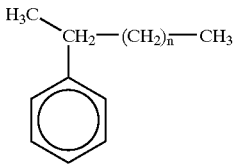

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

37. A composition of matter comprising alkylbenzenes, which are prepared according to a process comprising:

a) introducing a feed comprising olefin having about 8 to about 30 carbon atoms and benzene into a catalyst consisting essentially of fluorine-containing mordenite catalyst bed under conditions such that monoalkylated benzene is produced;

b) allowing benzene, olefin, and monoalkylated benzene to descend into a reboiler from the catalyst bed;

c) removing monoalkylated benzene from the reboiler; and d) heating the contents of the reboiler such that benzene refluxes to further contact the fluorine-containing mordenite, wherein the mordenite has been treated by contacting mordenite with an aqueous hydrogen fluoride solution, wherein the hydrogen fluoride in the aqueous solution has a concentration in the range from about 0.1 to about 1 percent by weight.

38. A process for producing an alkylbenzene sulfonic acid comprising the steps of:

a) providing a composition according to claim 37; and b) sulfonating a composition according to claim 37 to form an alkylbenzene sulfonic acid product.

39. The alkylbenzene sulfonic acid product produced by a process according to claim 38.

40. A process according to claim 38 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

41. The alkylbenzene sulfonate surfactant produced by the process of claim 40.

42. A composition useful as a detergent for cleaning laundry, dishes, hard surfaces, and other substrates that is formed from components comprising:

a) an alkylbenzene sulfonate surfactant component produced by a process according to claim 40 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

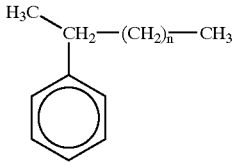

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

43. A composition of matter comprising alkylbenzenes, which are prepared according to a process comprising:

a) contacting benzene with an olefin of from about 5 to about 30 carbons in the presence of fluorine-containing mordenite under conditions such that monoalkylated benzene is formed; and b) contacting the effluent from step a) with benzene in the presence of a fluorine-containing clay catalyst, such that the product of step b) has a bromine number less than the bromine number of the product of step a).

44. A process for producing an alkylbenzene sulfonic acid comprising the steps of:

a) providing a composition according to claim 43; and b) sulfonating a composition according to claim 43 to form an alkylated benzene sulfonic acid product.

45. The alkylbenzene sulfonic acid product produced by a process according to claim 44.

46. A process according to claim 44 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

47. The alkylbenzene sulfonate surfactant produced by the process of claim 46.

48. A composition useful as a detergent for cleaning laundry, dishes, hard surfaces, and other substrates that is formed from components comprising:

a) an alkylbenzene sulfonate surfactant component produced by a process according to claim 46 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

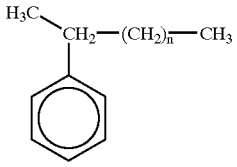

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

49. A composition of matter comprising alkylbenzenes, which are prepared according to a process comprising:

a) introducing a feed comprising olefin having about 5 to about 30 carbons and benzene into fluorine-containing mordenite catalyst bed under conditions such that monoalkylated benzene is produced;

b) collecting benzene, olefin, and monoalkylated benzene that descends from the catalyst bed in a reboiler;

c) heating the contents of the reboiler such that benzene refluxes to further contact the fluorine-containing mordenite;

d) removing monoalkylated benzene having a bromine number from the reboiler; and e) contacting the monoalkylated benzene removed from the reboiler with benzene in the presence of a fluorine-containing clay catalyst such that the bromine number of the monoalkylated benzene removed from the reboiler is reduced.

50. A process for producing an alkylbenzene sulfonic acid comprising the steps of:

a) providing a composition according to claim 49; and b) sulfonating a composition according to claim 49 to form an alkylbenzene sulfonic acid product.

51. The alkylbenzene sulfonic acid product produced by a process according to claim 50.

52. A process according to claim 50 further comprising: c) neutralizing the product of b) with a suitable alkaline substance containing one or more cations selected from the group consisting of: sodium, potassium, ammonium, magnesium and substituted ammonium alkalis, thus providing an alkylbenzene sulfonate surfactant.

53. The alkylbenzene sulfonate surfactant produced by the process of claim 52.

54. A composition useful as a detergent for cleaning laundry, dishes, hard surfaces, and other substrates that is formed from components comprising:

a) an alkylbenzene sulfonate surfactant component produced by a process according to claim 52 present in any amount between 0.25% and 99.50% by weight based upon the total weight of the composition, said component characterized as comprising any amount between 30.00% and 82.00% by weight based upon the total weight of the component, including every hundredth percentage therebetween, of water-soluble sulfonates of the 2-phenyl isomers of alkylbenzenes described by the general formula:

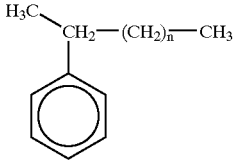

wherein n is equal to any integer between 4 and 16; and b) any amount between 99.75% and 0.50% of a second component that comprises at least one other component known to be useful in formulating soaps, detergents, and the like, wherein at least one of said other components is selected from the group consisting of: fatty acids, alkyl sulfates, an ethanolamine, an amine oxide, alkali carbonates, water, ethanol, isopropanol, pine oil, sodium chloride, sodium silicate, polymers, alcohol alkoxylates, zeolites, perborate salts, alkali sulfates, enzymes, hydrotropes, dyes, fragrances, preservatives, brighteners, builders, polyacrylates, essential oils, alkali hydroxides, water-soluble branched alkylbenzene sulfonates, ether sulfates, alkylphenol alkoxylates, fatty acid amides, alpha olefin sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, methyl ester sulfonates, alkyl polysaccharides, N-methyl glucamides, alkylated sulfonated diphenyl oxide, polyethylene glycol, and water soluble alkylbenzene sulfonates having a 2-phenyl isomer content of less than 40.00%.

* * * * *